US010906677B2

(12) United States Patent
Palumbo et al.

(10) Patent No.: US 10,906,677 B2
(45) Date of Patent: Feb. 2, 2021

(54) APPARATUS AND PROCESS FOR EVACUATION OF PACKAGES

(71) Applicants: Riccardo Palumbo, Arona (IT); Giulio Benedetti, Varese (IT); Stefano Landolt, Obernau (CH); Jvanohe Rizzi, Legnano (IT); Glen Samuel Kirkpatrick, Baar (CH); Peter Thurig, Eich (CH); Haris Nazic, Rothenburg (CH)

(72) Inventors: Riccardo Palumbo, Arona (IT); Giulio Benedetti, Varese (IT); Stefano Landolt, Obernau (CH); Jvanohe Rizzi, Legnano (IT); Glen Samuel Kirkpatrick, Baar (CH); Peter Thurig, Eich (CH); Haris Nazic, Rothenburg (CH)

(73) Assignee: Cryovac, LLC, Charlotte, NC (US)

( * ) Notice: Subject to any disclaimer, the term of this patent is extended or adjusted under 35 U.S.C. 154(b) by 275 days.

(21) Appl. No.: 15/774,838

(22) PCT Filed: Nov. 9, 2016

(86) PCT No.: PCT/EP2016/077182
§ 371 (c)(1),
(2) Date: May 9, 2018

(87) PCT Pub. No.: WO2017/081107
PCT Pub. Date: May 18, 2017

(65) Prior Publication Data

US 2018/0319523 A1 Nov. 8, 2018

(30) Foreign Application Priority Data

Nov. 10, 2015 (EP) ..... 15193959

(51) Int. Cl.
*B65B 31/02* (2006.01)
*B65B 51/16* (2006.01)
(Continued)

(52) U.S. Cl.
CPC ..... *B65B 31/024* (2013.01); *B65B 31/048* (2013.01); *B65B 51/146* (2013.01);
(Continued)

(58) Field of Classification Search
CPC ..... B65B 7/06; B65B 25/001; B65B 31/00; B65B 31/024; B65B 31/04; B65B 31/041;
(Continued)

(56) References Cited

U.S. PATENT DOCUMENTS 4,457,122 A * 7/1984 Atkins ..... B65B 31/024 53/434
4,457,124 A * 7/1984 Hartmann ..... B65B 5/045 53/284.7
(Continued)

FOREIGN PATENT DOCUMENTS

CN 101723107 6/2010
CN 204660099 9/2015
(Continued)

*Primary Examiner* — Hemant Desai
*Assistant Examiner* — Jacob A Smith
(74) *Attorney, Agent, or Firm* — Jason R. Womer

(57) ABSTRACT

A device (1) for evacuating gas from a package (50) in a packaging apparatus, the package (50) having an open end (55), the open end (55) having a terminal portion (54), a non-terminal portion (52), and an intermediate portion (53) located between the terminal portion (54) and the non-terminal portion (52) of the open end (55), the device (1) comprising a vacuum chamber (10) having an elongated opening (14) extending along a longitudinal axis of the vacuum chamber (10), an evacuation means configured for
(Continued)

providing the vacuum chamber (10) with an internal vacuum pressure that is lower than an ambient pressure outside the vacuum chamber (10), means for moving (30) a package (50) relative to the vacuum chamber (10), and a control unit (60) programmed for controlling the means for moving (30) to relatively move a package (50) to be evacuated with respect to the vacuum chamber (10), the package (50) and the means for moving (30) each being arranged with respect to the vacuum chamber (10) so that a main movement direction (40) of packages (50) placed on the means for moving (30) and the longitudinal axis of the vacuum chamber (10) are substantially parallel to one another, the package (50) to be evacuated being positioned so that, during the relative movement of the package (50) with respect to the vacuum chamber (10), a terminal portion (54) of the open end (55) of the package (50) relatively moves within the vacuum chamber (10) and a non-terminal portion (52) of the open end (55) relatively moves outside the vacuum chamber (10), an intermediate portion (53) of the open end (55) passing through and relatively moving along the opening (14), and activating the evacuation means to provide the vacuum chamber (10) with the internal vacuum pressure. A packaging process using the gas evacuation device and a packaging apparatus including the device are also disclosed.

19 Claims, 15 Drawing Sheets

(51) Int. Cl.

| | |
|---|---|
| ***B65B 57/04*** | (2006.01) |
| ***B65B 61/00*** | (2006.01) |
| ***B65B 31/04*** | (2006.01) |
| ***B65B 57/02*** | (2006.01) |
| ***B65B 51/14*** | (2006.01) |

(52) U.S. Cl.
CPC ..... *B65B 51/16* (2013.01); *B65B 57/02* (2013.01); *B65B 57/04* (2013.01); *B65B 61/005* (2013.01)

(58) Field of Classification Search
CPC . B65B 31/043; B65B 31/046; B65B 331/048; B65B 31/08; B65B 51/14; B65B 51/146; B65B 51/16; B65B 51/18; B65B 53/06; B65B 57/02; B65B 57/04; B65B 61/005
USPC ..... 53/373.5, 374.3, 374.5, 384.1, 492, 433, 53/434, 479, 512, 527
See application file for complete search history.

(56) References Cited

U.S. PATENT DOCUMENTS

| | | | | | |
|---|---|---|---|---|---|
| 4,471,599 | A * | 9/1984 | Mugnai | B65B 53/06 | 53/434 |
| 4,580,393 | A * | 4/1986 | Furukawa | B65B 31/022 | 53/253 |
| 4,620,411 | A * | 11/1986 | Schieser | B65B 43/123 | 53/281 |
| 4,640,081 | A * | 2/1987 | Kawaguchi | B65B 9/067 | 198/463.3 |
| 5,044,142 | A * | 9/1991 | Gianelli | B65B 31/024 | 53/434 |
| 5,435,114 | A * | 7/1995 | Moehlenbrock | B65B 5/045 | 53/434 |
| 5,442,895 | A * | 8/1995 | Linson | B65B 69/0008 | 414/412 |
| 5,941,052 | A * | 8/1999 | Evangelisti | B65B 51/303 | 53/433 |
| 7,487,625 | B2 * | 2/2009 | Natterer | B65B 9/04 | 53/433 |
| 8,099,931 | B2 * | 1/2012 | Grimm | B65B 61/02 | 53/434 |
| 9,073,654 | B2 | 7/2015 | Rothermel et al. | | |
| 2004/0025476 | A1 * | 2/2004 | Oliverio | B65B 43/267 | 53/450 |
| 2006/0231157 | A1 * | 10/2006 | Marcus | B65B 31/041 | 141/85 |
| 2006/0272291 | A1 * | 12/2006 | Koke | B65B 31/024 | 53/432 |
| 2006/0283149 | A1 * | 12/2006 | Passini | B65B 31/06 | 53/434 |
| 2007/0214752 | A1 * | 9/2007 | Buchko | B65B 31/024 | 53/512 |
| 2007/0234683 | A1 * | 10/2007 | Hatchell | B65B 31/00 | 53/434 |
| 2008/0022637 | A1 * | 1/2008 | Buchko | B65B 31/024 | 53/527 |
| 2009/0124477 | A1 * | 5/2009 | Veix | B65B 57/04 | 493/52 |
| 2009/0255221 | A1 * | 10/2009 | Lyman, Jr. | B65B 31/046 | 53/512 |
| 2010/0180548 | A1 * | 7/2010 | Binger | B65D 81/2038 | 53/434 |
| 2012/0110956 | A1 * | 5/2012 | Miller | B29C 66/1122 | 53/440 |
| 2013/0055689 | A1 * | 3/2013 | Hoepner | B65B 35/56 | 53/492 |
| 2013/0232925 | A1 * | 9/2013 | Huang | B65B 51/148 | 53/510 |
| 2014/0190125 | A1 * | 7/2014 | Rearick | B65B 35/44 | 53/434 |

FOREIGN PATENT DOCUMENTS

| | | | | |
|---|---|---|---|---|
| DE | 10149812 | A1 | 4/2003 | |
| DE | 102012220730 | A1 | 5/2014 | |
| EP | 0819081 | A1 | 1/1998 | |
| EP | 0928270 | A1 | 7/1999 | |
| EP | 0928270 | B1 * | 11/2000 | B65B 31/046 |
| WO | 2011016058 | | 2/2011 | |

* cited by examiner

FIG.8A
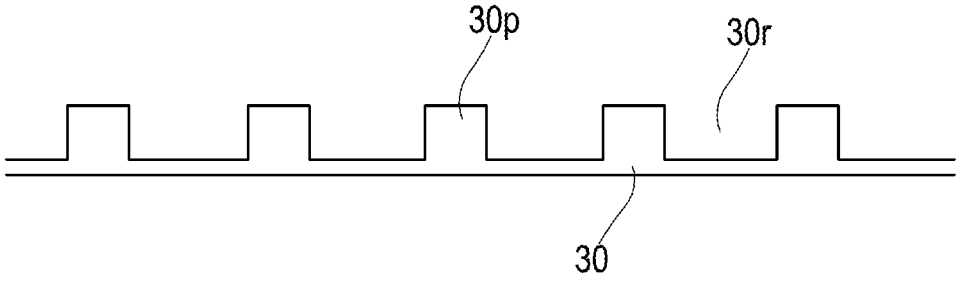
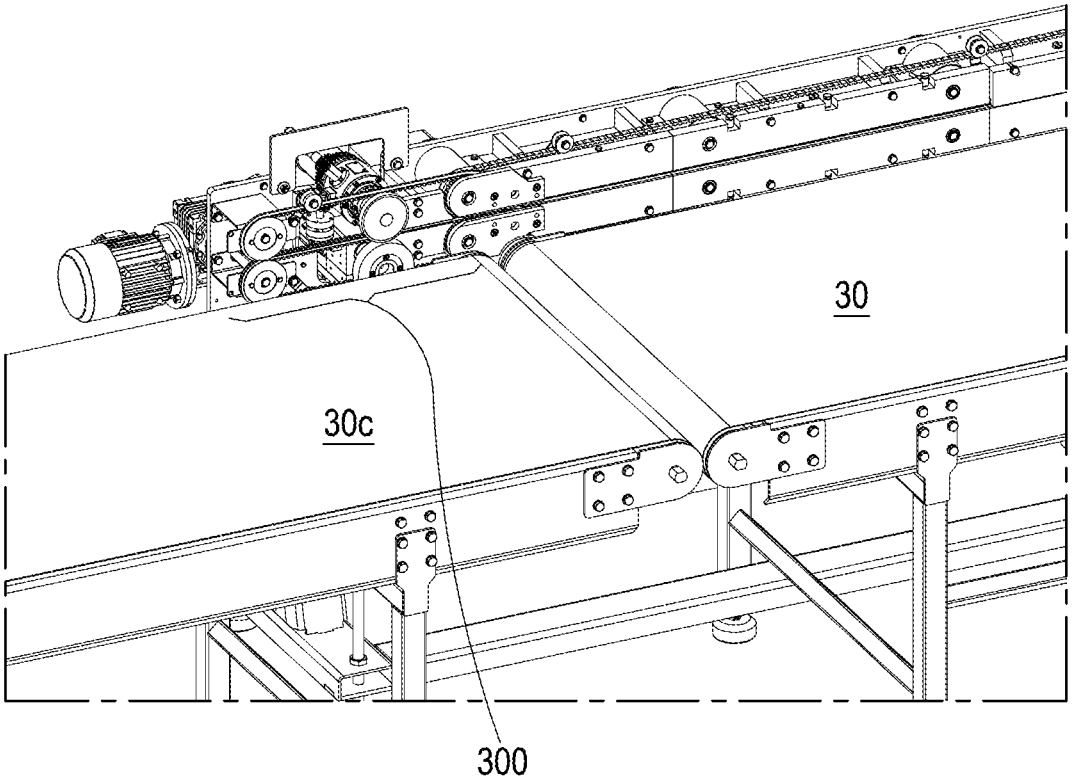
FIG.14A

FIG.10F
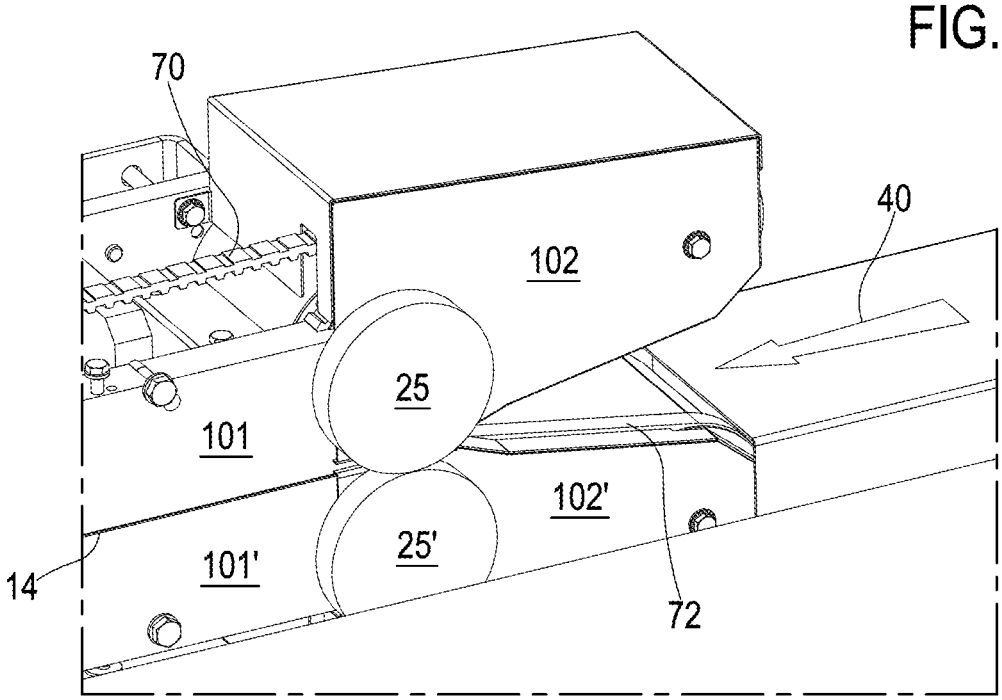
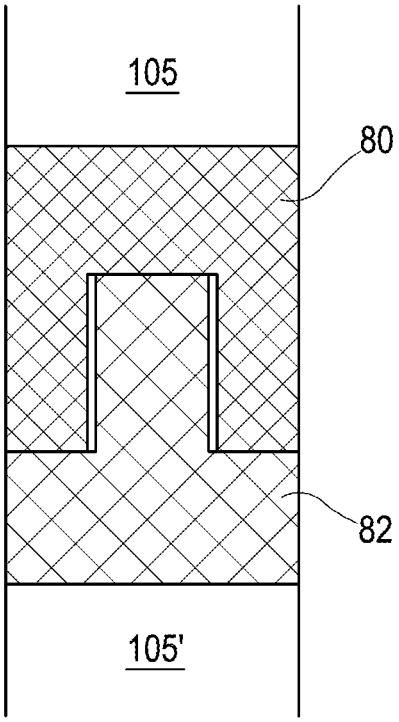
FIG.15A

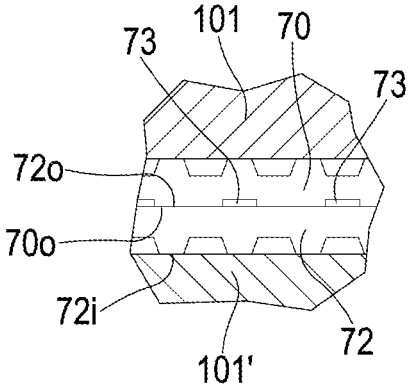
FIG.11A
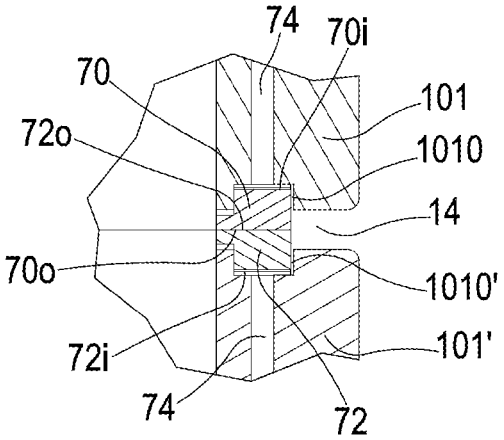
FIG.11B
FIG.12A
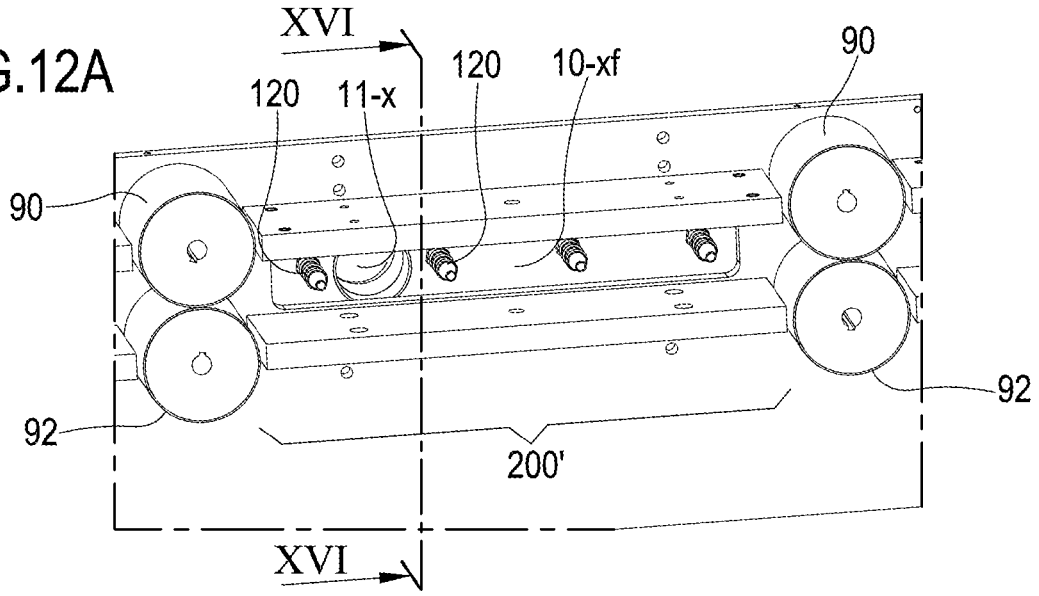
FIG.12B
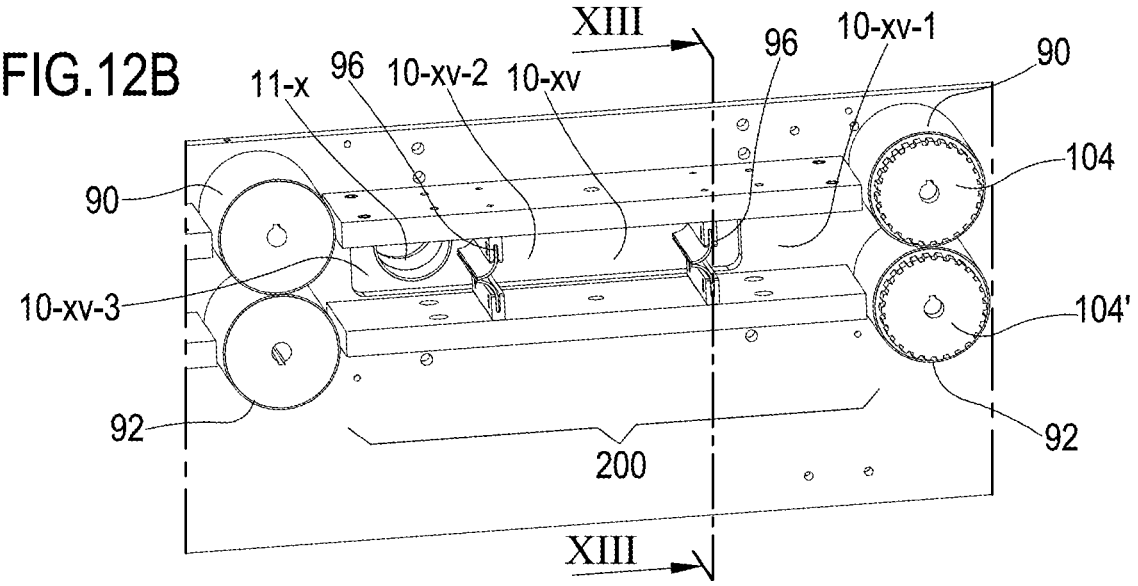

FIG.12E
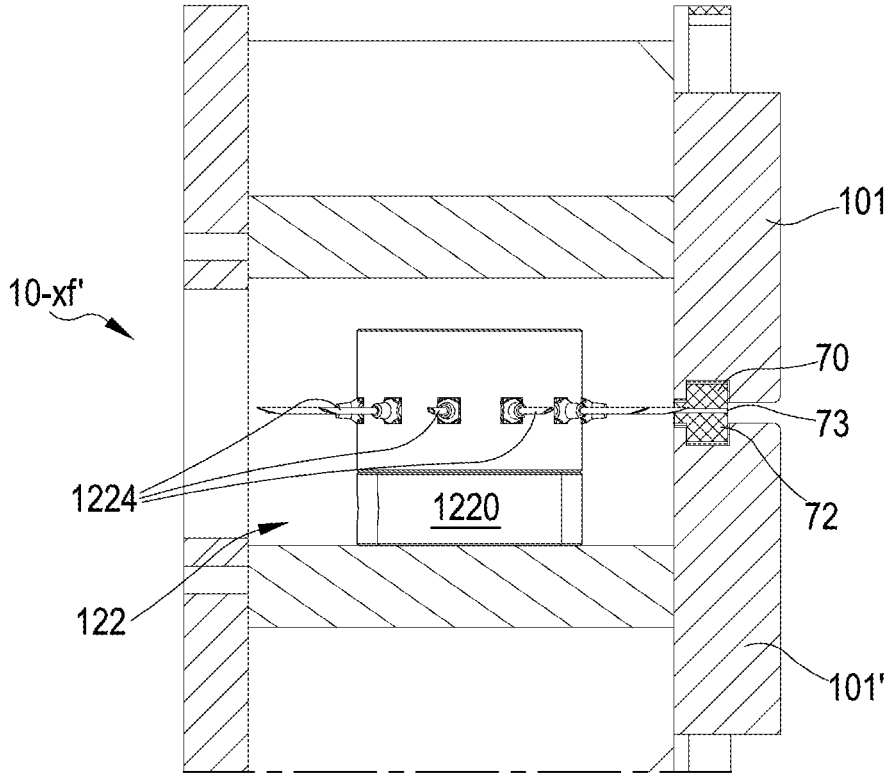
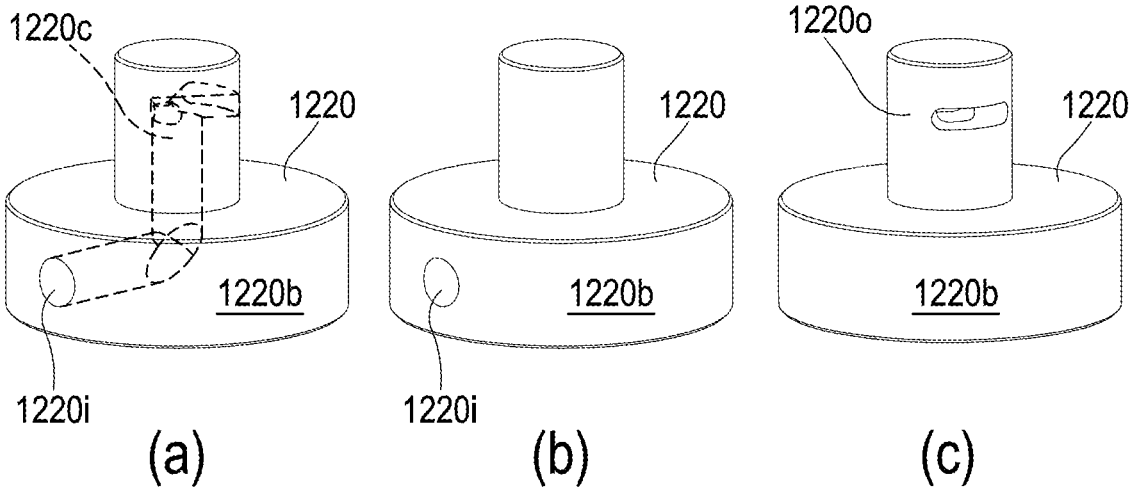
FIG.12F

FIG.13
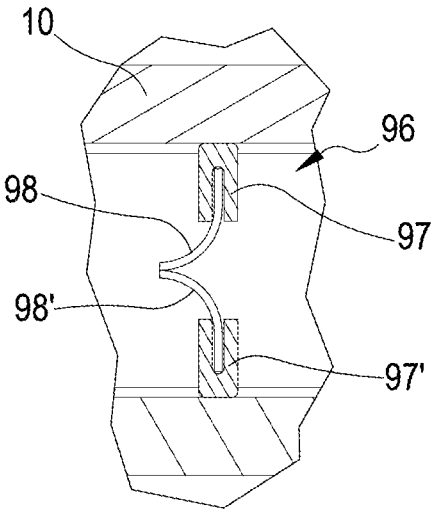
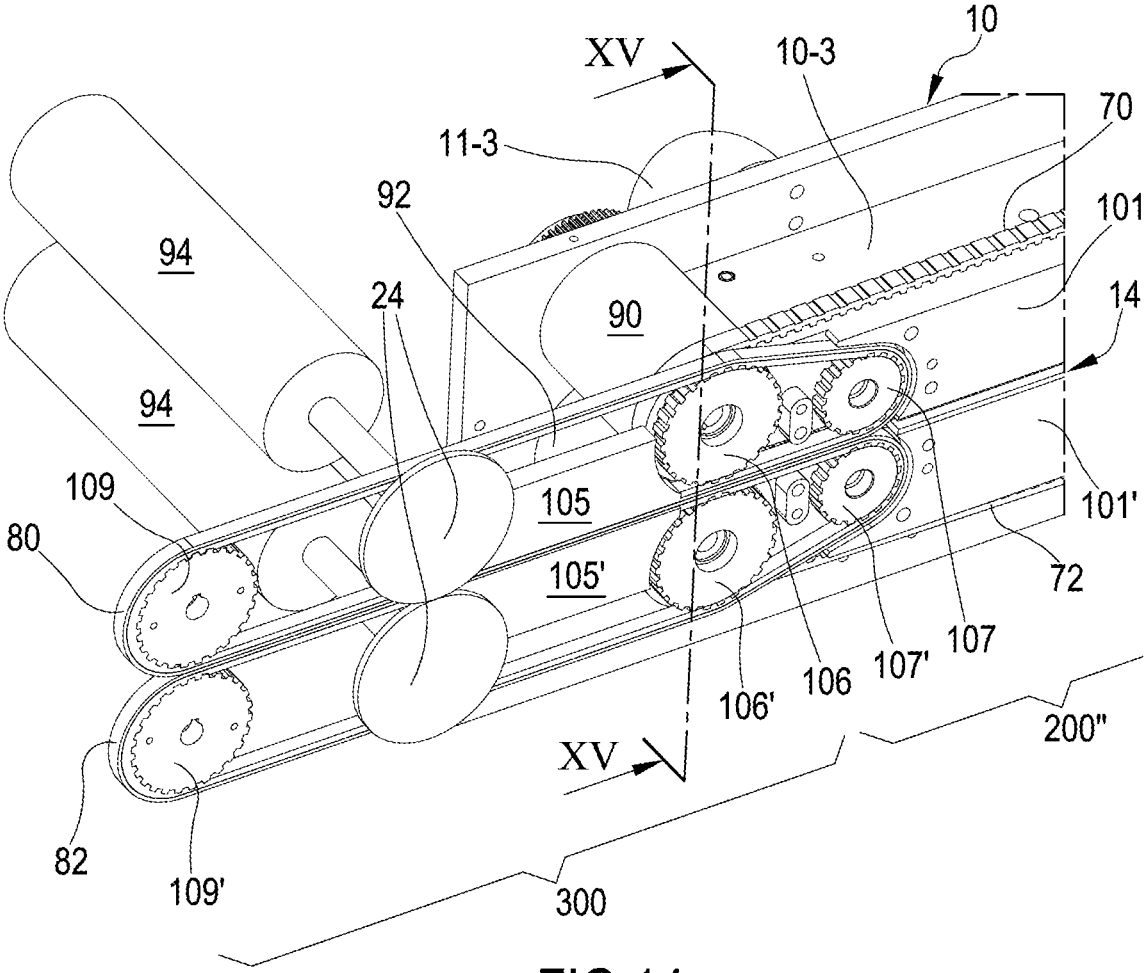
FIG.14

APPARATUS AND PROCESS FOR EVACUATION OF PACKAGES

TECHNICAL FIELD

The present invention relates to a packaging apparatus comprising an evacuation station and to a packaging process using an evacuation station. The packaging process includes evacuation of packages in a continuous vacuum system having a fixed-gap vacuum chamber.

BACKGROUND ART

A packaging apparatus can be used to package a food product. The product can be a bare product or a product pre-loaded onto a tray. A tube of plastic wrap can be continuously fed through a bag/package forming, filling and sealing apparatus. The film and the product are joined, for example the product is deposited on the film or the film is wrapped around the product. In some examples, the bare product is fed through an infeed belt. A tube is created around the product by joining together and sealing opposite longitudinal edges of the film. Alternatively, the product is placed in the tube and a leading edge (at the downstream end) of the packaging material is sealed. Then the tube is sealed at the trailing edge (at the upstream end) of the package and is severed from the continuously moving tube of packaging material.

In some embodiments, the tube can be provided as a tube, or be formed from two films or webs sealed longitudinally at two longitudinal edges, or from a single film that is folded over and sealed along its longitudinal edges. In other embodiments, products are loaded into pre-formed bags, which are then supplied to an evacuation station and to a sealing station. Further, some embodiments can facilitate evacuation of multiple packages at the same time in the same process step. The latter can be realized, for example, by processing multiple bags using a single vacuum system.

Sealing bars or sealing rolls can be used to create seals in the packaging material. If sealing bars are employed, a lower bar and an upper bar are moved with respect to one another in order to contact each other while squeezing the packaging material between the bars and providing one or more seals, for example by heat-sealing. Actuating sealing bars in this manner requires the sealing bars being stationary relative to the package, for example moving the sealing bars along with the package located on a conveyor or intermittently stopping the conveyor during the actuation of the sealing bars. Sealing rolls can be employed in order to maintain a continuous motion of packages on a conveyor belt. In some examples, packages are placed on a conveyor belt in an orientation where an unsealed end of the package, for example the open edge of a bag holding a product, is located laterally on the side of the conveyor with respect to a main movement direction of the conveyor. The open ends of the packages can then be fed through sealing rolls which perform, for example, heat sealing of the package material, without having to perform a complex synchronization of the movements of, for example, sealing bars with respect to the moving packages. The seals are typically transversally extending regions, stripes, or bands of packaging material that have been processed (e.g. heat-treated) to provide a seal between the inside of the packaging and the environment.

In the context of this document, whenever evacuation or vacuumization in terms of gas extraction is referred to, it is understood that the term "gas" can comprise an individual particular gas or a mixture of gases and can, for example, refer to air (i.e. consist of a mixture of gases corresponding to ambient air). In some embodiments, packages can be flushed with protective gas or gases (sometimes also referred to as "inert" gas). It is noted that any known protective gas or gas mixture can be employed, for example $CO_2$.

Gas can be injected into the package in the space between the product and the film using known techniques. Remaining gas inside the package after gas or air has been evacuated therefrom and after the package has been sealed ensures a desired residual level of $O_2$ inside the package. Reducing the level of residual $O_2$ in the package is particularly beneficial when packaging perishable products (e.g. cheese with low gassing level during maturation). In some applications, a residual $O_2$ level of 5% to 6% may be sufficient. In other applications, a residual $O_2$ level lower than 5%, for example 1% or lower, may be desirable. It is noted that, using embodiments of the present invention, practically any residual $O_2$ level necessary or desired for an individual packaging application may be set accordingly.

A packaging apparatus is typically used for numerous different products with respect to, for example, the type of product, size, weight, and composition. Some packaging machines employ one or more vacuum chambers, typically one of which is designed to house one or more entire products to be evacuated. Generally, such a setup may entail several limitations. For example, the complexity and cost for the equipment leaves room for improvement due to the many components required. Further, the sizes of products that can be processed are limited by the maximum size of the vacuum chamber holding the product during evacuation. In some applications, it is difficult to provide chambers of sufficient size due to structural limitation of some components (e.g. actuators, supports). Also, maintaining process reliability and durability of components may be difficult with increasing size of components (e.g. chambers, actuators, gaskets) as the size typically impacts wear and tear properties. Additionally, processing times may increase due to vacuumization of larger chambers taking comparably longer time.

An aim of the present invention is to provide a packaging process that facilitates efficient packaging of products of larger sizes using a (soft) vacuum system suitable for a wide variety of sizes of products. A further aim of the present invention is to provide a packaging process that facilitates evacuation of gas and/or air from a package in a continuous manner. In particular, it is an aim of the invention to provide a packaging apparatus capable of executing the packaging process of the invention.

SUMMARY OF INVENTION

According to the invention, in a 1$^{st}$ aspect there is provided a packaging process comprising providing a package containing a product to be packaged, the package being made from a film and having an open end, providing a vacuum chamber having an elongated opening, relatively moving one of the package and the vacuum chamber with respect to the other such that a terminal portion of the open end relatively moves within the vacuum chamber and a non-terminal portion of the open end relatively moves outside the vacuum chamber, an intermediate portion of the open end passing through the opening and relatively moving along a length thereof, the intermediate portion extending between the terminal portion and the non-terminal portion of the open end, creating, within the vacuum chamber, an internal vacuum pressure that is lower than an ambient pressure outside the vacuum chamber.

In a $2^{nd}$ aspect according to the $1^{st}$ aspect, the step of creating an internal vacuum pressure within the vacuum chamber further comprises selecting the internal vacuum pressure such as to determine a gas flow through the opening causing opposing layers of the film at the open end to maintain a substantially spaced-apart configuration.

In a $3^{rd}$ aspect according to any one of aspects 1 or 2, the step of creating an internal vacuum pressure within the vacuum chamber further comprises selecting the internal vacuum pressure such as to aspirate both gas from inside the package and gas from an ambient atmosphere through the opening.

In another aspect in accordance with any one of aspects 1 to 3, the means for moving are provided with elongated recesses located on an upper side of an upper run of the means for moving, each elongated recess having one or more openings configured to facilitate aspiration of air from the upper side of the upper run through the one or more openings and to a lower side of the upper run, the process further comprising aspirating air from the upper side through the one or more openings to the lower side in order to cause the film of the package to conform to a shape of the upper side and, in particular, to cause ingress of the film into the elongated recesses, thereby forming elongated channels in the film material situated below the product to be packaged.

In a $4^{th}$ aspect according to any one of the $1^{st}$ aspect to the preceding aspect, the opening extends substantially parallel to a longitudinal axis of the vacuum chamber.

In a $5^{th}$ aspect according to any one of aspects 1 to 4, the opening is provided with a first guide belt arranged along a length of the opening and configured to contact the intermediate portion of the open end when passing through the opening, the first guide belt having an inner surface and an outer surface, the process further comprising moving the first guide belt along the length of the opening, optionally at a speed substantially corresponding to the relative speed between the package and the vacuum chamber.

In a $6^{th}$ aspect according to the $5^{th}$ aspect, the outer surface of the first guide belt is provided with a contoured shape comprising recesses, optionally wherein the recesses extend over the outer surface in a direction perpendicular to a longitudinal extension of the first guide belt; and/or the recesses are spaced from one another at regular intervals along the longitudinal extension of the first guide belt, the intervals preferably being between 2 mm and 20 mm, more preferably between 5 mm and 15 mm, most preferably about 10 mm; and/or the recesses have a depth of between 0.2 mm and 2 mm, preferably between 0.5 mm and 1.5 mm, most preferably about 1 mm; and/or the recesses have a length along the longitudinal extension of the first guide belt of between 2 mm and 10 mm, more preferably between 3 mm and 8 mm, most preferably about 5 mm.

In a $7^{th}$ aspect according to the $6^{th}$ aspect, the regular intervals are about 10 mm, the recesses have a depth of about 1 mm, and the recesses have a length along the longitudinal extension of the first guide belt of about 5 mm.

In an $8^{th}$ aspect according to any one of aspects 5 to 7, the first guide belt has the form of a closed loop running around first and second deflection rolls and along the length of the opening.

In a $9^{th}$ aspect according to any one of aspects 1 to 8, the opening is provided with a second guide belt arranged along a length of the opening and configured to contact the intermediate portion of the open end when passing through the opening, the second guide belt having an inner surface and an outer surface, the process further comprising moving the second guide belt along the length of the opening, optionally at a speed substantially corresponding to the relative speed between the package and the vacuum chamber.

In a $10^{th}$ aspect according to the $9^{th}$ aspect, the outer surface of the second guide belt is provided with a substantially smooth shape.

In an $11^{th}$ aspect according to any one of aspects 8 or 9, the second guide belt has the form of a closed loop running around first and second deflection rolls and along the length of the opening.

In a $12^{th}$ aspect according to any one of aspects 5 to 8 and any one of aspects 9 to 11, the inner surface of the first guide belt extends along an upper edge of the opening and the outer surface of the first guide belt is configured to contact the intermediate portion from above, and the inner surface of the second guide belt extends along a lower edge of the opening and the outer surface of the second guide belt is configured to contact the intermediate portion from below.

In a $13^{th}$ aspect according to any one of aspects 1 to 12, relatively moving one of the package and the vacuum chamber with respect to the other comprises relatively moving one of the package and the vacuum chamber with respect to the other at a relative speed of between 5 m/min and 30 m/min, preferably between 10 m/min and 20 m/min.

In a $14^{th}$ aspect according to any one of aspects 1 to 13, relatively moving one of the package and the vacuum chamber comprises relatively moving one of the package and the vacuum chamber along a movement direction substantially parallel to the longitudinal axis of the vacuum chamber.

In a $15^{th}$ aspect according to any one of aspects 1 to 14, the process further comprises creating a seal on the package at the open end, thereby forming a sealed package containing the product and having a sealed end; optionally the step of creating the seal on the package being performed when aspirating gas from inside the package has been substantially concluded.

In a $16^{th}$ aspect according to any one of aspects 1 to 15, the step of providing the package comprises positioning a tubular film around the product to be packaged, and creating, at a sealing station, a first seal on the tubular film, thereby forming the package containing the product to be packaged, and optionally creating a longitudinal seal along a film in order to obtain the tubular film.

In a $17^{th}$ aspect according to any one of aspects 1 to 16, the step of providing the package comprises creating the open end by one or more of perforating the package in the region of the terminal portion of the open end; cutting the package in the region of the terminal portion of the open end; and creating an aperture in the package in the region of the terminal portion of the open end.

In an $18^{th}$ aspect according to the $17^{th}$ aspect, the process further comprises the step of flushing the inside of the package with gas or a mixture of gases; optionally wherein the gas or mixture of gases comprise an inert gas; further optionally wherein the gas substantially consists of or comprises CO2.

In a $19^{th}$ aspect according to any one of aspects 1 to 18, the process further comprises providing the opening with a height of 8 to 20 times a thickness of the film, or providing the opening with a height of 1.0 mm or less, preferably 0.8 mm or less, most preferably 0.5 mm or less, or providing the opening with a height of between 0.3 mm and 1.0 mm, preferably between 0.3 mm and 0.8 mm, most preferably between 0.3 mm and 0.5 mm.

In a $20^{th}$ aspect according to any one of aspects 1 to 19, the vacuum chamber is provided with upper and lower rollers, each roller having a substantially cylindrical shape and being arranged to be able to rotate about a respective longitudinal axis thereof, the upper and lower rollers being relatively positioned with respect to one another such that the upper and lower rollers contact each other along an elongated contact area on their respective lateral surfaces, thereby providing the rollers with a substantially air-tight seal along the contact area, the contact area extending substantially parallel to the respective longitudinal axis of the upper and lower rollers, wherein a first set of rollers is arranged at an upstream end of the vacuum chamber and configured to provide the vacuum chamber with a substantially air-tight seal at the upstream end thereof; and/or a second set of rollers is arranged at a downstream end of the vacuum chamber and configured to provide the vacuum chamber with a substantially air-tight seal at the downstream end thereof, downstream being defined with respect to the main movement direction.

In a 21$^{st}$ aspect according to any one of aspects 1 to 20, creating the internal vacuum pressure within the vacuum chamber comprises creating an internal vacuum pressure of between 950 mbar and 500 mbar, preferably between 800 mbar and 525 mbar, most preferably between 700 mbar and 550 mbar.

In a 22$^{nd}$ aspect according to any one of aspects 1 to 21, the vacuum chamber comprises a first sub-chamber and a second sub-chamber.

In a 23$^{rd}$ aspect according to the 22$^{nd}$ aspect, the process further comprises providing the first sub-chamber with a first pressure and providing the second sub-chamber with a second pressure different from the first pressure, optionally wherein the second pressure comprises a lower absolute pressure value than the first pressure, or the first pressure comprises an absolute pressure value lower than the ambient pressure and the second pressure comprises an absolute pressure value substantially equal to or higher than the ambient pressure.

In a 24$^{th}$ aspect according to any one of aspects 22 or 23, the vacuum chamber comprises a third sub-chamber, the process further comprising providing the third sub-chamber with a third pressure different from the first and second pressures, optionally the third pressure comprising a lower absolute pressure value than each of the first and second pressures.

In a 25$^{th}$ aspect according to the 2$^{th}$ aspect and any one of aspects 22 to 24, the vacuum chamber comprises one or more additional sets of rollers, each additional set of rollers being arranged between adjacent sub-chambers.

In a 26$^{th}$ aspect according to any one of aspects 1 to 25, the process further comprises a first stretch belt arranged at the downstream end of the vacuum chamber and configured to receive the intermediate portion of the open end when exiting the opening, optionally the process further comprising controlling an operating speed of the first stretch belt to be higher than the relative speed between the package and the vacuum chamber, the operating speed preferably being about 2% to 30% higher than the relative speed between the package and the vacuum chamber, the operating speed more preferably being about 3% to 12% higher than the relative speed between the package and the vacuum chamber.

In a 27$^{th}$ aspect according to the 26$^{th}$ aspect and any one of aspects 5 to 8, the first stretch belt is arranged in a plane parallel to an operating plane of the first guide belt and in partial overlap with an operating region of the first guide belt.

In a 28$^{th}$ aspect according to any one of aspects 26 or 27, the process further comprises a second stretch belt arranged opposite to and in contact with the first stretch belt at the downstream end of the vacuum chamber, the first and second stretch belts being configured to receive, between one another, the intermediate portion of the open end when exiting the opening, optionally the process further comprising controlling an operating speed of the second stretch belt to be higher than the relative speed between the package and the vacuum chamber, the operating speed preferably being about 2% to 30% higher than the relative speed between the package and the vacuum chamber, the operating speed more preferably being about 3% to 12% higher than the relative speed between the package and the vacuum chamber.

In a 29$^{th}$ aspect according to the 28$^{th}$ aspect and any one of aspects 9 to 11, the second stretch belt is arranged in a plane parallel to an operating plane of the second guide belt and in partial overlap with an operating region of the second guide belt.

In a 30$^{th}$ aspect according to any one of aspects 1 to 29, the vacuum chamber further comprises a set of stretch rollers arranged at the downstream end of the vacuum chamber and configured to receive the intermediate portion of the open end when exiting the opening, optionally the process further comprising controlling an operating speed of the stretch rollers to be higher than the relative speed between the package and the vacuum chamber, the operating speed preferably being about 2% to 30% higher than the relative speed between the package and the vacuum chamber, the operating speed more preferably being about 3% to 12% higher than the relative speed between the package and the vacuum chamber.

According to the invention, in a 31$^{st}$ aspect, there is provided a device for evacuating gas from a package in a packaging apparatus, the package having an open end, the open end having a terminal portion, a non-terminal portion, and an intermediate portion located between the terminal portion and the non-terminal portion of the open end, the device comprising a vacuum chamber having an elongated opening extending along a longitudinal axis of the vacuum chamber, an evacuation means configured for providing the vacuum chamber with an internal vacuum pressure that is lower than an ambient pressure outside the vacuum chamber, a means for moving a package relative to the vacuum chamber, and a control unit programmed for controlling the means for moving to relatively move a package to be evacuated with respect to the vacuum chamber, the package and the means for moving each being arranged with respect to the vacuum chamber so that a main movement direction of packages placed on the means for moving and the longitudinal axis of the vacuum chamber are substantially parallel to one another, the package to be evacuated being positioned so that, during the relative movement of the package with respect to the vacuum chamber, a terminal portion of the open end of the package relatively moves within the vacuum chamber and a non-terminal portion of the open end relatively moves outside the vacuum chamber, an intermediate portion of the open end passing through and relatively moving along the opening, and activating the evacuation means to provide the vacuum chamber with the internal vacuum pressure.

In a 32$^{nd}$ aspect according to the 31$^{st}$ aspect, the control unit is further programmed to control the internal vacuum pressure for allowing a gas flow through the opening causing opposing layers of film at the open end to maintain a substantially spaced-apart configuration.

In a 33$^{rd}$ aspect according to any one of aspects 31 or 32, the control unit is further programmed to control the internal vacuum pressure for aspirating both gas from inside the package and gas from an ambient atmosphere through the opening.

In another aspect in accordance with any one of aspects 31 to 33, the means for moving are provided with elongated recesses located on an upper side of an upper run of the means for moving, each elongated recess having one or more openings configured to facilitate aspiration of air from the upper side of the upper run through the one or more openings and to a lower side of the upper run.

In a 34$^{th}$ aspect according to any one of the 33$^{rd}$ aspect or the preceding aspect, the opening extends substantially parallel to a longitudinal axis of the vacuum chamber.

In a 35$^{th}$ aspect according to any one of aspects 31 to 34, the device further comprises a first guide belt arranged along a length of the opening and configured to contact the intermediate portion of the open end when passing through the opening, the first guide belt having an inner surface and an outer surface, and a first drive configured to act on the first guide belt, wherein the control unit is further programmed to control the first drive to move the first guide belt in the movement direction along the length of the opening, optionally, at a speed substantially corresponding to optionally at a speed substantially corresponding to the relative speed between the package and the vacuum chamber.

In a 36$^{th}$ aspect according to the 35$^{th}$ aspect, the outer surface of the first guide belt is provided with a contoured shape comprising recesses, optionally wherein the recesses extend over the outer surface in a direction perpendicular to a longitudinal extension of the first guide belt; and/or the recesses are spaced from one another at regular intervals along the longitudinal extension of the first guide belt, the intervals preferably being between 2 mm and 20 mm, more preferably between 5 mm and 15 mm, most preferably about 10 mm; and/or the recesses have a depth of between 0.2 mm and 2 mm, preferably between 0.5 mm and 1.5 mm, most preferably about 1 mm; and/or the recesses have a length along the longitudinal extension of the first guide belt of between 2 mm and 10 mm, more preferably between 3 mm and 8 mm, most preferably about 5 mm.

In a 37$^{th}$ aspect according to the 36$^{th}$ aspect, the regular intervals are about 10 mm, the recesses have a depth of about 1 mm, and the recesses have a length along the longitudinal extension of the first guide belt of about 5 mm.

In a 38$^{th}$ aspect according to any one of aspects 35 to 37, the first guide belt has the form of a closed loop running around first and second deflection rolls and along the length of the opening.

In a 39$^{th}$ aspect according to any one of aspects 35 to 38, the device further comprises a second guide belt arranged along a length of the opening and configured to contact the intermediate portion of the open end when passing through the opening, the second guide belt having an inner surface and an outer surface, and a second drive configured to act on the second guide belt, wherein the control unit is further programmed to control the second drive to move the second guide belt in the movement direction along the length of the opening, optionally at a speed substantially corresponding to the relative speed between the package and the vacuum chamber.

In a 40$^{th}$ aspect according to the 39$^{th}$ aspect, the outer surface of the second guide belt is provided with a substantially even shape.

In a 41$^{th}$ aspect according to any one of aspects 39 to 40, the second guide belt has the form of a closed loop running around first and second deflection rolls and along the length of the opening.

In a 42$^{nd}$ aspect according to any one of aspects 35 to 38 and any one of aspects 39 to 41, the inner surface of the first guide belt extends along an upper edge of the opening and the outer surface of the first guide belt is configured to contact the intermediate portion from above, and the inner surface of the second guide belt extends along a lower edge of the opening and the outer surface of the second guide belt is configured to contact the intermediate portion from below.

In a 43$^{th}$ aspect according to any one of aspects 31 to 42, the control unit is further programmed for controlling the means for moving to relatively move a package to be evacuated at a relative speed of between 5 m/min and 30 m/min, preferably between 10 m/min and 20 m/min.

In a 44$^{th}$ aspect according to any one of aspects 31 to 43, the device further comprises multiple sets of upper and lower rollers, each roller having a substantially cylindrical shape and being arranged to be able to rotate about a respective longitudinal axis thereof, the upper and lower rollers being relatively positioned with respect to one another such that the upper and lower rollers contact each other along an elongated contact area on their respective lateral surfaces, thereby providing the rollers with a substantially air-tight seal along the contact area, the contact area extending substantially parallel to the respective longitudinal axis of the upper and lower rollers, wherein a first set of rollers is arranged at an upstream end of the vacuum chamber and configured to provide the vacuum chamber with a substantially air-tight seal at the upstream end thereof; and/or a second set of rollers is arranged at a downstream end of the vacuum chamber and configured to provide the vacuum chamber with a substantially air-tight seal at the downstream end thereof, downstream being defined with respect to the main movement direction.

In a 45$^{th}$ aspect according to any one of aspects 31 to 44, the vacuum chamber comprises a first sub-chamber and a second sub-chamber.

In a 46$^{th}$ aspect according to the 45$^{th}$ aspect, the control unit is further programmed to provide the first sub-chamber with a first pressure and to provide the second sub-chamber with a second pressure different from the first pressure, optionally wherein the second pressure comprises a lower absolute pressure value than the first pressure, or the first pressure comprises an absolute pressure value lower than the ambient pressure and the second pressure comprises an absolute pressure value substantially equal to or higher than the ambient pressure.

In a 47$^{th}$ aspect according to any one of aspects 45 and 46, the vacuum chamber comprises a third sub-chamber, the control unit further being programmed to provide the third sub-chamber with a third pressure different from the first and second pressures, optionally the third pressure comprising a lower absolute pressure value than each of the first and second pressures.

In a 48$^{th}$ aspect according to the 44$^{th}$ aspect and any one of aspects 45 to 47, the vacuum chamber comprises one or more additional sets of rollers, each additional set of rollers being arranged between adjacent sub-chambers.

In a 49$^{th}$ aspect according to any one of aspects 31 to 48, the device further comprises a first stretch belt arranged at the downstream end of the vacuum chamber and configured to receive the intermediate portion of the open end when exiting the opening, optionally the control unit being configured to control an operating speed of the first stretch belt to be higher than the relative speed between the package and the vacuum chamber, the operating speed preferably being about 2% to 30% higher than the relative speed between the package and the vacuum chamber, the operating speed more preferably being about 3% to 12% higher than the relative speed between the package and the vacuum chamber.

In a 50$^{th}$ aspect according to the 49$^{th}$ aspect and any one of aspects 35 to 38, the first stretch belt is arranged in a plane parallel to an operating plane of the first guide belt and in partial overlap with an operating region of the first guide belt.

In a 51$^{st}$ aspect according to any one of aspects 49 to 50, the device further comprises a second stretch belt arranged opposite to and in contact with the first stretch belt at the downstream end of the vacuum chamber, the first and second stretch belts being configured to receive, between one another, the intermediate portion of the open end when exiting the opening, optionally the control unit being configured to control an operating speed of the second stretch belt to be higher than the relative speed between the package and the vacuum chamber, the operating speed preferably being about 2% to 30% higher than the relative speed between the package and the vacuum chamber, the operating speed more preferably being about 3% to 12% higher than the relative speed between the package and the vacuum chamber.

In a 52$^{nd}$ aspect according to the 51$^{st}$ aspect and any one of aspects 39 to 41, the second stretch belt is arranged in a plane parallel to an operating plane of the second guide belt and in partial overlap with an operating region of the second guide belt.

In a 53$^{rd}$ aspect according to any one of aspects 31 to 48, the device further comprises a set of stretch rollers arranged at the downstream end of the vacuum chamber and configured to receive the intermediate portion of the open end when exiting the opening, optionally the control unit being configured to control an operating speed of the stretch rollers to be higher than the relative speed between the package and the vacuum chamber, the operating speed preferably being about 2% to 30% higher than the relative speed between the package and the vacuum chamber, the operating speed more preferably being about 3% to 12% higher than the relative speed between the package and the vacuum chamber.

In a 54$^{th}$ aspect according to any one of aspects 31 to 53, the device further comprises sealing means configured to provide a package being relatively moved with respect to the vacuum chamber with a seal; optionally the sealing means being configured to provide the seal in the region of the non-terminal portion, and/or the sealing means comprising one of a trimmer and a knife roll.

In a 55$^{th}$ aspect according to the 54$^{th}$ aspect, the sealing means are arranged at a downstream end of the vacuum chamber.

In a 56$^{th}$ aspect according to any one of aspects 54 or 55, the control unit is further programmed for controlling the sealing means to provide a package being relatively moved with respect to the vacuum chamber with the seal.

In a 57$^{th}$ aspect according to the 56$^{th}$ aspect, the device further comprises cutting means configured to cut excess film material from a package being relatively moved with respect to the vacuum chamber; optionally the package being cut in the region of the intermediate portion or the excess film material substantially comprising the terminal portion and the intermediate portion.

In a 58$^{th}$ aspect according to the 57$^{th}$ aspect, the cutting means are arranged at a downstream end of the vacuum chamber.

In a 59$^{th}$ aspect according to any one of aspects 57 or 58, the control unit is further programmed for controlling the cutting means to cause cutting of excess film material.

In a 60$^{th}$ aspect according to any one of aspects 31 to 59, the opening has a height of 8 to 20 times a thickness of the film, or the opening has a height of 10 times a thickness of the film or less; or the opening has a height of between 0.3 mm and 1.0 mm, optionally the opening having a height of 1.0 mm or less, preferably 0.8 mm or less, most preferably 0.5 mm or less.

In a 61$^{st}$ aspect according to any one of aspects 31 to 60, the opening has a depth of 50 mm or less, preferably 20 mm or less, and more preferably 12 mm or less. In a 62$^{nd}$ aspect according to any one of aspects 31 to 61, the control unit is programmed for controlling the evacuation means to create an internal vacuum pressure of between 950 mbar and 500 mbar, preferably between 800 mbar and 525 mbar, most preferably between 700 mbar and 550 mbar.

In another aspect according to any one of aspects 31 to 62 in combination with aspect 36, the device further comprises one or more flusher assemblies, each of the one or more flusher assemblies comprising a flusher support rotatably carrying a nozzle head, the nozzle head having a plurality of nozzles. Each nozzle of the plurality of nozzles is configured to engage and disengage a respective recess of the recesses during movement of the first guide belt, thereby being positioned, when engaged, at least partially within the open end of the package. The flusher support further comprises a conduit configured to direct a flow of controlled gas towards the respective nozzle or nozzles of the plurality of nozzles while engaging a corresponding recess of the recesses. The conduit may further be configured to prevent a supply of controlled gas to the respective nozzle or nozzles of the plurality of nozzles while not engaging a corresponding recess of the recesses.

According to the invention, in a 63$^{rd}$ aspect there is provided a packaging apparatus comprising an evacuation station coupled to the control unit and an output station. The control unit is configured to control the means for moving to move one or more packages, each containing a product to be packaged, towards and through the evacuation station, and towards the output station; wherein the evacuation station comprises a device for evacuating according to any one of aspects 31 to 62.

In a 64$^{th}$ aspect according to the 63$^{rd}$ aspect, the apparatus further comprises a loading station coupled to the control unit, the control unit being configured to control the loading station to position a tubular film around products to be packaged; and a sealing station coupled to the control unit, the control unit being configured to control the sealing station to create one or more seals on the tubular film, thereby creating the one or more packages, each containing one of the products to be packaged, wherein the control unit is configured to control the means for moving to move the one or more packages from the loading station towards and through the sealing station.

In a 65$^{th}$ aspect there is provided a packaging process for use with a device according to any one of aspects 31 to 62 for evacuating gas from a package in a packaging apparatus, the process comprising providing a package containing a product to be packaged, the package being made from a film and having an open end, providing a vacuum chamber having an elongated opening, relatively moving one of the package and the vacuum chamber with respect to the other such that a terminal portion of the open end relatively moves within the vacuum chamber and a non-terminal portion of the open end relatively moves outside the vacuum chamber, an intermediate portion of the open end passing through the opening and relatively moving along a length thereof, the intermediate portion extending between the terminal portion and the non-terminal portion of the open end, creating, within the vacuum chamber, an internal vacuum pressure that is lower than an ambient pressure outside the vacuum chamber.

In a 66$^{th}$ aspect according to the 65$^{th}$ aspect, the step of providing the package comprises creating the open end by one or more of perforating the package in the region of the terminal portion of the open end; cutting the package in the region of the terminal portion of the open end; and creating an aperture in the package in the region of the terminal portion of the open end. Alternatively or additionally, the process further comprises the step of flushing the inside of the package with gas or a mixture of gases; optionally wherein the gas or mixture of gases comprises an inert gas; further optionally wherein the gas substantially consists of or comprises CO2.

In a 67$^{th}$ aspect according to any one of aspects 65 or 66, the step of creating an internal vacuum pressure within the vacuum chamber further comprises selecting the internal vacuum pressure such as to determine a gas flow through the opening causing opposing layers of the film at the open end in order to maintain a substantially spaced-apart configuration; and/or aspirate both gas from inside the package and gas from an ambient atmosphere through the opening.

In a 68$^{th}$ aspect according to any one of aspects 65 to 67, the process further comprises guiding the intermediate portion of the open end along a length of the opening while relatively moving one of the package and the vacuum chamber with respect to the other; and/or creating wrinkles in the film at the open end of the package, optionally substantially within a region where the intermediate portion of the open end enters the vacuum chamber, further optionally maintaining the wrinkles in the film substantially throughout the moving of the intermediate portion along the length of the opening; and/or removing wrinkles from and/or flattening the film at the open end of the package, optionally substantially within a region where the intermediate portion of the open end exits the vacuum chamber; and/or creating elongated wrinkles in the film an area of the package substantially in contact with the means for moving.

In a 69$^{th}$ aspect according to any one of aspects 65 to 68, the process further comprises allowing lateral movement of the package and/or of the film material at the open end of the package in a direction perpendicular to the movement direction such that a change in volume of the package and/or a change in the shape of the film of the package while relatively moving one of the package and the vacuum chamber with respect to the other can be accommodated.

Advantages of the packaging process and the packaging apparatus include that the packaging process can be performed using a relatively small vacuum chamber having a fixed gap allowing movement of a portion of the package (e.g. bag neck, unsealed end of package). Evacuating a smaller chamber and maintaining a vacuum within a smaller chamber can be significantly more efficient than evacuating larger chambers designed to house the entire product/package during vacuumization. Further improvements entail lower costs and less space requirements at the same processing rate (e.g. $m^2$/1 ppm).

Advantages of the packaging process and the packaging apparatus further include that packages can be evacuated continuously and in a serial manner, thereby reducing complexity of the vacuum system. This can also entail a reduction in processing times and/or processing costs due to continuous processing as opposed to batch processing.

Advantages of the packaging process and the packaging apparatus further include that products of larger and/or variable sizes can be efficiently packaged irrespective of the size of the vacuum chamber. For example, products having a same height but varying length and width can be processed without any changes to the packaging apparatus or process. The size of the vacuum chamber does not limit the size of the packages that can be processed. Additionally, the packaging apparatus can be easily adapted for processing products of a different height.

Advantages of the packaging process and the packaging apparatus also include that wrinkle generation (beneficial, e.g., for vacuumization) and flattening (beneficial, e.g., for sealing) can be integrated into the continuous processing as the products/packages are in motion during these stages.

Advantages of the packaging process and the packaging apparatus further include that monitoring the process (e.g. vacuumization) can be performed more easily due to the products/packages being freely accessible as opposed to being enclosed in a vacuum chamber.

Advantages of the packaging process and the packaging apparatus additionally include that the packaging apparatus can be easily adapted to individual applications. For example, the width of the main conveyor belt can be changed in order to accommodate products of particular length. Further, processing speed and evacuation time can be changed by adapting the operation speed of the main conveyor and/or by employing a longer or shorter vacuum chamber.

Advantages of the packaging process and the packaging apparatus further include that the risk of deterioration of the products (e.g. molding caused by residual oxygen) can be reduced by providing the packages with a protective gas, prior to evacuation of gas or air.

The packaging process may also facilitate full integration and automation with a vertical or horizontal form, fill, and seal (VFFS, HFFS) apparatus.

BRIEF DESCRIPTION OF DRAWINGS

FIG. 8A shows a cross section view of a conveyor belt in accordance with embodiments of the invention;

FIG. 10F shows an isometric front view of an alternative embodiment of an intake section of an evacuation station according to the present invention;

FIGS. 11A and 11B show cross sections of upper and lower belts as employed in the third embodiment of an evacuation station according to the present invention;

FIG. 12A shows the inside of a flusher chamber that can be employed with an evacuation station according to the present invention;

FIG. 12B shows an evacuation chamber that can be employed with an evacuation station according to the present invention, the evacuation chamber having multiple compartments separated by dividers;

FIG. 12E shows a cross section view of the flusher chamber of FIG. 12C of an evacuation station according to the present invention;

FIG. 12 F shows isometric views of a flusher support of a flusher assembly as shown in FIGS. 12D-12E that can be employed with an evacuation station according to the present invention;

FIG. 13 shows a cross section of a divider as shown in FIG. 12B;

FIG. 14 shows an isometric view of an outlet section of an evacuation station according to the present invention;

FIG. 14A shows an isometric front view of an outlet section in accordance with embodiments of the present invention, the outlet section being provided with a separate exit belt;

FIG. 15A shows a cross section view of a stretch belt in accordance with embodiments of the present invention;

DETAILED DESCRIPTION

Figure 1:
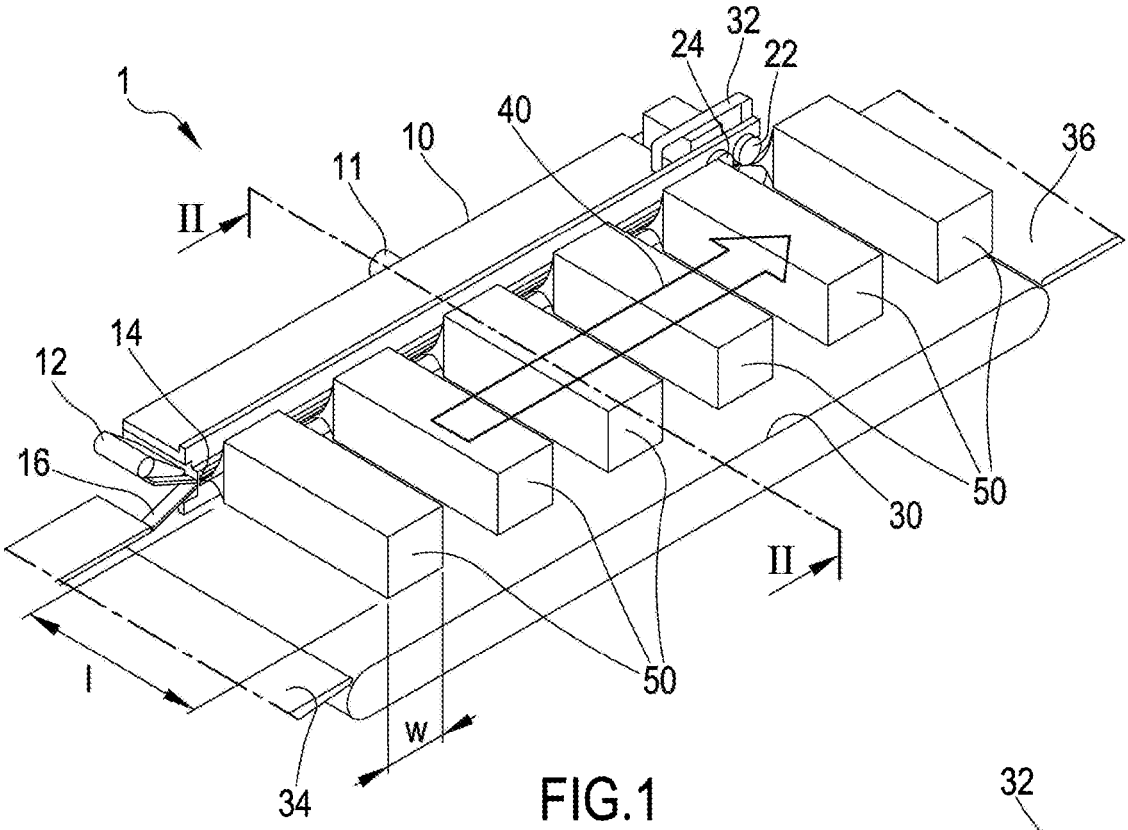
FIG. 1 shows a first embodiment of an evacuation station of a packaging apparatus according to the present invention.
Figure 2:
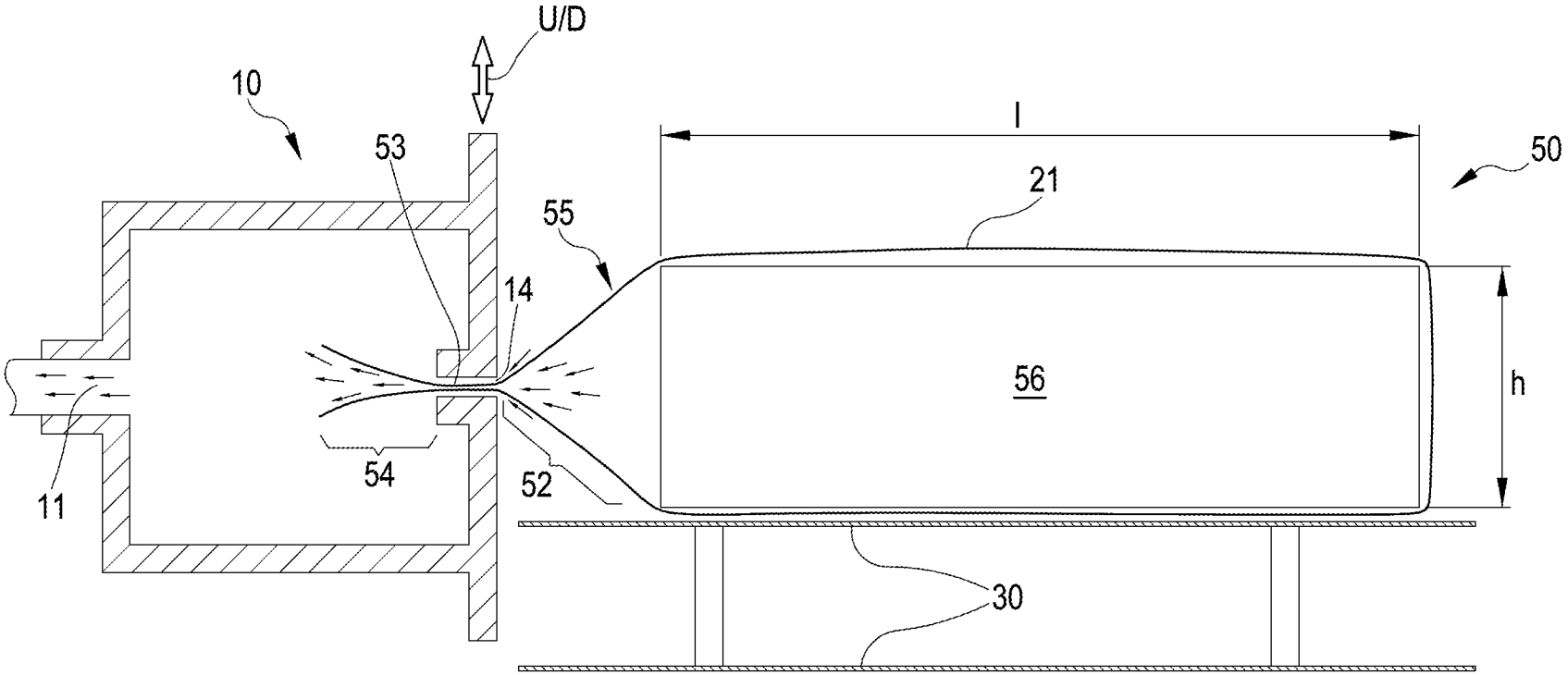
FIG. 2 shows a cross section view of the evacuation station shown in FIG. 1, the cross section view being taken along the line II-II.

FIG. 1 shows a first embodiment of an evacuation station 1 of a packaging apparatus according to the present invention. A packaging apparatus typically comprises further components, for example a loading station for loading products and a sealing station for sealing packages 50 (such further components not shown in FIG. 1). The packaging apparatus has one or more means for moving the products or packages 50, for example one or more conveyor belts including an infeed belt, a main conveyor belt 30, and an outfeed belt (or exit belt). The means for moving are configured to move products placed inside a film or packages 50 from the loading station towards and through the sealing station and towards and through the evacuation station 1. The placement of packages on the transport means (e.g. on the conveyor belt) further defines relative directions as to up, down, above, below, etc. as can be seen, for example, in FIGS. 1, 6, 8, 9, etc., showing isometric views of the arrangement of different components. In FIG. 2, for example, which shows a cross section of the transport means 30 and of the chamber 10, the arrow U/D extends along the up/down directions, "down" being in the direction towards the package 50 (i.e. towards the bottom of FIG. 2), which is placed on an (upper) surface of the conveyor belt 30. Consequently, the direction "up" is indicated by arrow U/D in the direction away from the package 50 (i.e. towards the top of FIG. 2). Corresponding terms, for example "upper", "lower", "above", "below", etc. are understood to be read within the above-described context of the products being placed on the transport means 30, as shown in the figures.

Evacuation station 1 includes a main conveyor belt 30 and infeed 34 and outfeed 36 areas in order to facilitate the introduction of packages 50 into a working zone of evacuation station 1 and to transport the packages 50 through and away from the evacuation station 1. Alongside the main conveyor belt 30, an evacuation chamber 10 is located. The evacuation chamber has an elongated opening 14 extending substantially parallel to a longitudinal axis of the evacuation chamber 10 along a sidewall thereof. The opening 14 defines a fixed gap (e.g. having a height that is substantially fixed along the length of the vacuum chamber 10) extending substantially parallel to the movement direction 40. At an upstream end of the evacuation chamber 10 (upstream being defined with respect to movement direction 40 of packages 50 through evacuation station 1), a bag neck guide 16 and/or a belt guide 12 is/are provided in order to reliably introduce the bag necks of packages 50 (e.g. film material in correspondence of the open end 55 of each package 50) into the fixed-gap opening 14. At the downstream end of the evacuation chamber 10, sealing rolls 24 can be provided, including a corresponding sealing roll motor, knife rolls 22, and/or a trimmer for trimming excess material. It is noted that the terms "upstream" and "downstream" are defined with respect to the main movement direction 40 of products through the packaging apparatus.

In some embodiments, the packages 50 are provided as packages having sealed ends (e.g. a first sealed end and a second sealed end). Before evacuation, a sealed end of a respective package 50 can be perforated or provided with an aperture in order to provide the package 50 with the open end 55. The perforation or aperture is provided in the terminal portion 54 of the open end 55, such that the terminal portion 54 of the open end 55 and, thus, the perforation or aperture, is guided through the vacuum chamber 10. In other embodiments, a seal present at the terminal portion 54 (e.g. a seal extending along an edge of the package 50, can be cut in order to create the open end 55. Similarly, the cut is provided in the terminal portion 54 of the open end 55, such that the terminal portion 54 of the open end 55 and, thus, the opening created by the cut, is guided through the vacuum chamber 10.

Evacuation chamber 10 further has a fluid connector 11 configured to be attached to a vacuum source (e.g. a vacuum pump; not shown). In this manner, gas or air can be evacuated from evacuation chamber 10 through fluid connector 11 and, thus, the vacuum chamber can be provided with an internal vacuum pressure that is below ambient pressure. A suitable vacuum source is a vacuum pump operating at, for example, about 1200 $m^3/h$ and 500 mbar of absolute pressure.

Typically, products are loaded onto a continuously supplied film, for example supplied from a roll of film, the film being subsequently longitudinally sealed in order to create a sequence of packages 50, i.e. products placed in the tubular film. This can be performed at a loading station (not shown in FIG. 1). Optionally, a flusher (not shown) may be provided in order to flush the inside of the tubular film with a protective gas or mixture of gases. The gas or gases may substantially comprise or consist of $CO_2$. The packages 50 may be provided to the evacuation station 1 in a state where the inside of the packages 50 has already been flushed (e.g. at a loading station, or between a loading station and the evacuation station using a separate flushing station). As described below, the evacuation station 1 can include a flushing chamber in which (additional) flushing can be performed.

It is assumed that once packages 50 reach evacuation station 1 along movement direction 40 as shown in FIG. 1, the packages 50 have been formed by placing packaging film 21 around a product 56 and sealing the film along one or more edges. In an alternative, products 56 have been placed in pre-formed bags made from packaging film 21. Subsequently, packages 50 are arranged on a main conveyor belt 30 so that an open end of each package 50, i.e. an unsealed portion of package 50, is positioned facing towards the side of the conveyor belt 30 at which the vacuum chamber 10 is located (e.g. towards the left with respect to direction 40, as shown in FIG. 1).

It is noted that each of the packages 50 can have different dimensions, in particular with respect to length l and width w, as compared to other packages 50 being processed in the same packaging apparatus. The length l of a package 50 refers to the extension of the package 50 parallel to the surface of the main conveyor 30 and perpendicular to the movement direction 40. The width w of a package refers to the extension of the package 50 parallel to the surface of the main conveyor 30 and in the direction of the movement direction 40. Packages 50 are placed and positioned such that the open ends 55 of the packages 50 are lined up with respect to the side of the main conveyor belt 30 facing the vacuum chamber 10, so that the series of open ends 55 is arranged parallel to the movement direction 40 and in alignment with the opening 14 of the vacuum chamber 10.

In FIG. 1, packages 50 are shown having the same dimensions and are, thus, positioned substantially identically along the length of evacuation station 1. It is, however, understood that packages having different length l and/or different width w can be processed by evacuation station 1 without any major adjustments to the evacuation process or the evacuation station. Packages of different length and/or width are simply placed so that the respective open ends of the packages are positioned in substantially the same position with respect to vacuum chamber 10 as packages are moved along evacuation station 1 by the main conveyor 30. Opposite ends of packages 50 will, thus, not be aligned if said packages 50 have varying lengths.

A packaging apparatus, for example an apparatus including an evacuation station such as evacuation station 1, typically comprises a control unit. The control unit and individual connections to components of the packaging apparatus are not shown for clarity. It is understood that the control unit is connected to one or more components of the packaging apparatus, for example one or more of a loading station, a sealing station, and a flusher. A flusher may be provided in order to flush the inside of the packaging film 21 with a protective gas or mixture of gases. The control unit is further connected to evacuation station 1 and to the main conveyor belt 30. At the evacuation station 1, gas or air is evacuated from the packages 50.

The control unit may further be connected to additional components, such as a hot air or shrink tunnel, where the film material around packaged products 50 can additionally undergo heat-shrinking after the packages 50 having been evacuated and sealed. It is understood that the packaging apparatus can comprise common connection means for connecting the control unit to any components controlled, for example electrical, optical, or other connections and/or leads.

The control unit can be configured for controlling the transport of packages 50 along a predefined path, for example by controlling a motor associated with main conveyor belt 30. The control unit can further control the actuators of different components, for example, in order to create seals on the tubular film or in order to control sealing bars (e.g. sealing bars 26, 27; see below), sealing rolls (e.g. sealing rolls 24; see below), knife rolls, vacuum pumps, etc. The control unit is configured to send and/or receive control signals to/from the vacuum source (e.g. a vacuum pump). The control unit can further be configured to control the vacuum pump to provide an internal vacuum pressure to vacuum chamber 10. To this aim, the control unit can be configured to control a power driving the vacuum pump connected to vacuum chamber 10. The control unit is further configured to control the main conveyor 30. For example, the control unit can be configured to increase or decrease an operating speed of the main conveyor belt 30. The control unit can further be configured to control the operating speed of the main conveyor 30 depending on a position of products 50 with respect to different components of the packaging apparatus. In embodiments in which the packages 50 are moved relative to the vacuum chamber 10, the main conveyor belt 30 can be controlled to move the packages 50 relative to the vacuum chamber 10 at a predetermined relative speed, for example between about 5 m/min to about 30 m/min, preferably between about 10 m/min to about 20 m/min.

The control unit can comprise a digital processor (CPU) with memory (or memories), an analogical type circuit, or a combination of one or more digital processing units with one or more analogical processing circuits. In the present description and in the claims it is indicated that the control unit is "configured" or "programmed" to execute certain steps. This may be achieved in practice by any means, which allow for configuring or programming the control unit. For instance, in case of a control unit comprising one or more CPUs, one or more programs are stored in an appropriate memory. The program or programs contain instructions, which, when executed by the control unit, cause the control unit to execute the steps described and/or claimed in connection with the control unit. Alternatively, if the control unit is of an analogical type, then the circuitry of the control unit is designed to include circuitry configured, in use, to process electric signals such as to execute the control unit steps herein disclosed.

FIG. 2 shows a cross section view of the evacuation station shown in FIG. 1, the cross section view being taken along the line II-II. Different components shown in FIG. 2 are shown not to scale but schematically for reasons of clarity. FIG. 2 shows a cross section of vacuum chamber 10. Fluid connector 11 is configured to connect to a suitable vacuum source (not shown) and to provide the vacuum chamber 10 with a corresponding vacuum pressure. Arrows indicate flow of gas or air during evacuation of package 50, namely from inside package 50 and from around package 50 into and through vacuum chamber 10, for example when the vacuum pump is operational. Fixed-gap opening 14 extends along the length of the vacuum chamber 10 and is configured to enable the desired flow of gas or air from outside the vacuum chamber 10 through opening 14, into the vacuum chamber, and further towards fluid connector 11. To this aim, opening 14 is provided with a profile and dimensions suitable for the respective process. The opening can have, for example, a rounded and/or tapered cross section, in order to improve the evacuation process and/or to reduce noise and/or energy consumption of the system. In some examples, terminal edges of the opening (e.g. an outer edge facing the outside of the vacuum chamber 10 and/or an inner edge facing the inside of the vacuum chamber 10) can have a rounded cross section. This can prevent clogging or damage of the film material being moved along the opening 14 and/or improve the separation of opposite layers of film material inside the vacuum chamber 10. The opening can further have a tapered cross section which increases in size from outside towards inside the vacuum chamber (e.g. increasing from about 1 mm height of the opening towards the outside to about 3 to 5 mm height of the opening towards the inside of the vacuum chamber 10). Based on a number of parameters, for example the size of the package 50, the products 56 contained therein, and the properties of packaging film 21, the properties of opening 14 are determined. This is detailed further below.

With respect to both FIGS. 1 and 2, a package 50 is placed on the main conveyor belt 30 and positioned such that a terminal portion 54 of the open end 55 of package 50 is positioned inside the vacuum chamber 10. Further, a non-terminal portion 52 of the open end 55 of the package remains outside of the vacuum chamber, and an intermediate portion 53 of the open end, located between the terminal 54 and non-terminal 52 portions of the open end 55, is located within the opening 14. In order to achieve this particular positioning of the open ends 55 of packages 50, vacuum chamber 10 includes a guide or guides 16 and/or a belt or belts 12 at an upstream end of the vacuum chamber.

FIG. 2 illustrates the positioning of packages 50 with respect to directions perpendicular to movement direction 40, which in FIG. 2 is perpendicular to the viewing plane. Packages 50 can be positioned along their length l (i.e. horizontally as seen in FIG. 2) simply by placing packages 50 on main conveyor 30 in the desired position. Horizontal positioning of the open end 55 of packages 50 is, thus, achieved by corresponding placement of packages on main conveyor 30. It is noted that the individual length l of a package 50 is relevant only insofar as the width of main conveyor 30 is concerned. Longer packages 50 can be placed on main conveyor 30 as long as they are well supported (e.g. as long as the center of gravity of a package 50 is located within the supporting area of main conveyor 30). The main conveyor 30 can, furthermore, be selected based on a maximum width thereof, thus defining a maximum length l for products 56 being processed.

Vertical positioning of the open end 55 of packages 50 can be achieved by relatively adjusting the vertical spatial relationship (i.e. vertical as seen in FIG. 2) of the main conveyor 30 and the vacuum chamber 10. In some embodiments, vacuum chamber 10 is vertically adjustable with respect to main conveyor 30 in order to facilitate processing of packages having varying height h (e.g. as indicated by arrow U/D in FIG. 2). In other embodiments, main conveyor 30 can be vertically adjustable with respect to vacuum chamber 10. It is noted that typically the vertical position of open end 55 of packages 50 as shown in FIG. 2 depends on the height h of the respective package, wherein the height of the open end 55 typically is half the height h of the package 50. It is understood that packages 50 may be provided having open end 55 at a different height with respect to the package height h, for example lower or higher than h/2. In such applications, vacuum chamber 10 can be relatively adjusted so that opening 14 and open ends 55 are aligned.

Packages 50 are positioned and the vertical position of vacuum chamber 10 or main conveyor 30 is adjusted so that open ends 55 of packages 50 are substantially positioned within an operating region of guides 16 and/or belts 12 in a longitudinal extension of vacuum chamber 10 and opening 14. This facilitates introduction of the open ends 55 into and through vacuum chamber 10 during movement of packages 50 along direction 40 into and through evacuation station 1.

While open ends 55 are guided into opening 14 and moved along the length thereof, vacuum pressure applied to vacuum chamber 10 causes aspiration of gas or air through opening 14 from inside packages 50 and from around ambient air outside packages 50 as indicated by arrows in FIG. 2. The relative movement of packages 50 and, more precisely the relative movement of the film material 21 at open end 55 of packages 50, prevents sticking or adhesion of film 21 to the upper and lower edges of opening 14. Further, the flow of gas or air facilitates separation of opposing layers of film 21 at the open end of package 50 and of substantially keeping opposing layers of film 21 in a spaced-apart configuration, thereby facilitating efficient evacuation of gas or air from package 50. At this stage, wrinkles in the film material 21 at the open end 55 of packages 50 support evacuation of packages 50 due to the creation of channels through which air/gas can be drawn from inside packages 50.

The length of vacuum chamber 10 along movement direction 40 (see FIG. 1) and the operating speed of main conveyor 30 can be adjusted in order to modify a time period during which evacuation of packages 50 is performed. For example, providing a longer chamber 10 or lowering the operating speed of main conveyor 30 increases the time period during which packages 50 are evacuated. Similarly, providing a shorter chamber 10 or increasing the operating speed of main conveyor 30 decreases the time period during which packages 50 are evacuated. Additionally, the vacuum pressure applied to vacuum chamber 10 can be increased or decreased as desired, thereby further modifying the evacuation process. A higher pressure difference between the vacuum chamber (low pressure) and the ambient atmosphere (ambient pressure) increases the evacuation of packages 50.

In one example, evacuation station 1 can be configured in accordance with the following parameters. Evacuation station 1 is configured to accommodate and process products of up to 1500 mm in length (e.g. based on a width of main conveyor 30). The desired evacuation time is set at a minimum of 5 seconds and the operating speed of main conveyor is set at a maximum of 20 m/min (i.e. 0.33 m/s). Vacuum chamber 10, thus, has to be provided with a length of at least 1.7 m in order to provide the minimum evacuation time taking into account the operating speed of main conveyor 30. Not including infeed (guides 16, belts 12) and outfeed areas, or an operating area for the sealing rolls and the knife rolls, vacuum chamber has a length of about 2 m. In this example, opening 14 is provided with a size (opening height) of 0.5 mm. Further, vacuum chamber 10 is provided with an absolute pressure of 600 mbar. The desired air speed in opening 14 is set at 250 m/s, necessitating an air flow rate from chamber 10 of about 1125 $m^3$/h. Air flow rate is calculated based on the air speed (250 m/s; see above)×gap width (0.5 mm; see above)×gap length (estimated to be 2.5 m). In the present example: 250 m/s×0.0005 m×2.5 m=0.3125 $m^3/s$=1125 $m^3/h$. It is understood that these exemplary values can be modified in accordance with the individual application in order to account for different processing times, different film material, etc.

The processing speed of evacuation station 1 can be calculated as follows. Processing packages containing products 56 having a width of 450 mm (and, e.g., length 500 mm, height 100 mm) and arranging the packages at a distance of 50 mm with respect to one another results in a throughput of 40 packages per minute (ppm), the evacuation time being 5 seconds. This is based on: conveyor speed/(width+spacing) =20 m/min/(0.45 m+0.05 m)=40 ppm. In another example, products 56 of 120 mm width (1200 mm length, 100 mm height) are processed, where the products are placed in bags (i.e. packages) of 250 mm width and the evacuation time is set at 10 seconds (i.e. operating speed of the main conveyor 30 of 10 m/min). The throughput in this latter example is: 10 m/min/(0.25 m+0.05 m)=33 ppm.

Figure 3:
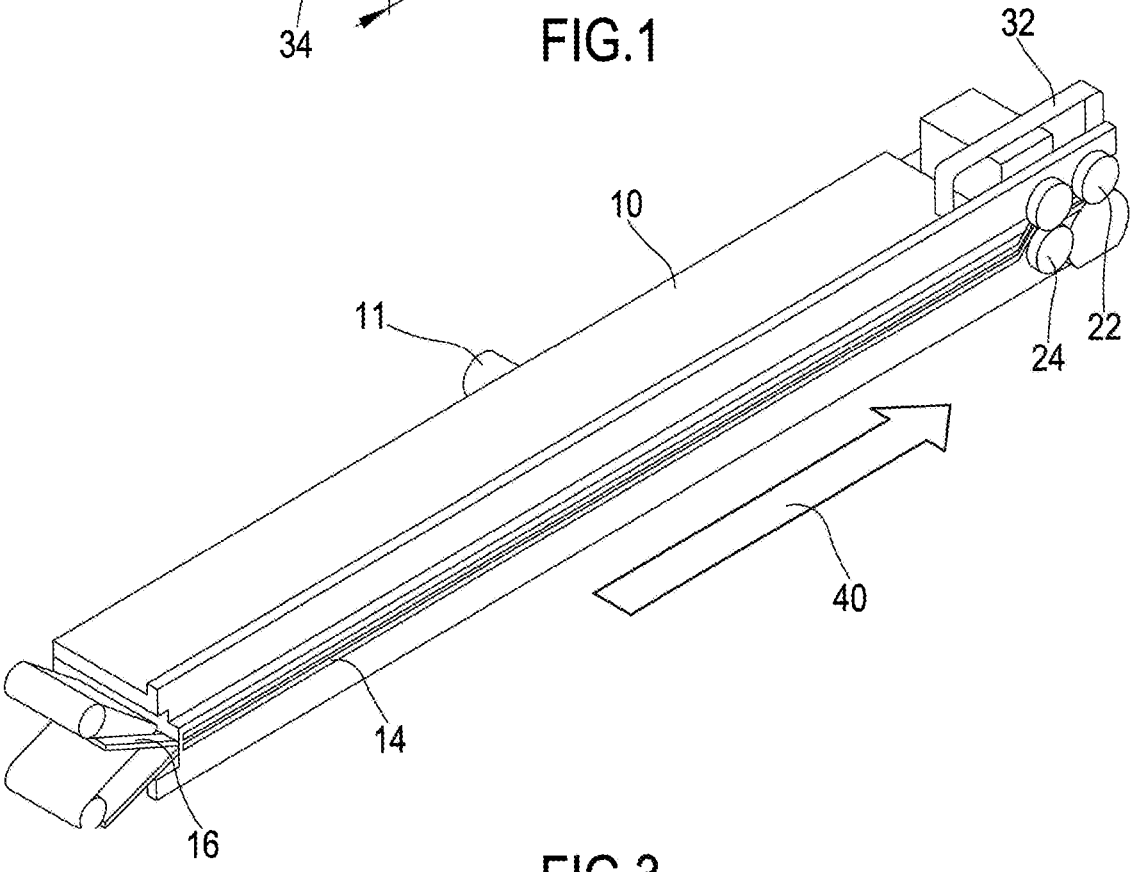
FIG. 3 shows a fixed-gap vacuum chamber of an evacuation station according to the present invention.

FIG. 3 shows a fixed-gap vacuum chamber of an evacuation station 1 according to the present invention. At the upstream end of the vacuum chamber 10, guides 16 and belts 12 are arranged and configured to collect and introduce the open end 55 of a package 50 being moved along the movement direction 40 into the vacuum chamber 10 as the package is moved relative to the vacuum chamber 10. Main conveyor belt 30 creates relative movement between the package 50 and the vacuum chamber 10 such that the open end 55 of package 50 is moved towards guides 16 and/or belts 12, which then cause the open end 55 to be collected and guided towards and into opening 14. In the embodiment shown in FIGS. 1 and 3, the guides 16 and belts 12 are arranged in a V-shaped configuration in order to collect open ends 55 of packages 50 largely independent from the individual shape of open end 55 (e.g. being bent upwards or downwards, being flat or having wrinkles, etc.).

At the downstream end of vacuum chamber 10 a sealing roll assembly 24 is configured to seal the open ends 55 of packages 50 in a continuous manner, for example by heat-sealing. Here, sealing roll assemblies known in the art can be employed, for example those including two rolls carrying heating elements and being arranged to act upon film material from opposite sides, heat-sealing the film material as it is directed between the sealing rolls and through the sealing roll assembly. Subsequently, suitable cutting means, for example a knife roll, cuts excess film material from packages 50. Typically, packages 50 are sealed in the region of the non-terminal portion 52 and excess film material is cut in the region of the intermediate portion 53, optionally close to the non-terminal portion 52. In some embodiments, little or no excess film material is cut. If excess film material is cut, a corresponding container (not shown) receiving the cut material can be provided.

Figure 4:
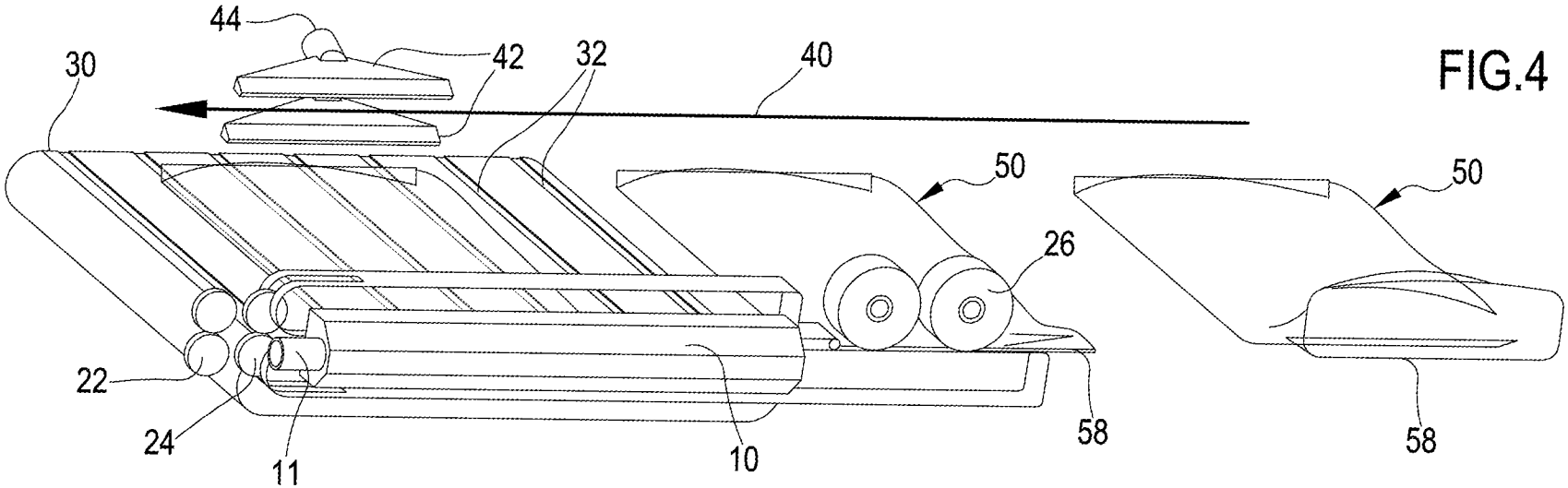
FIG. 4 shows a second embodiment of an evacuation station of a packaging apparatus according to the present invention.

FIG. 4 shows a second embodiment of an evacuation station of a packaging apparatus according to the present invention. In this second embodiment the vacuum chamber 10 is arranged and configured largely identical to the first embodiment. The movement direction 40 of packages 50 moving through evacuation station 1 is from right to left in FIG. 4. As shown, packages 50 are provided with plies using corresponding rollers 26 (e.g. pinch rollers). Rollers 26 further perform a function similar to that of guides 16 or belts 12 in the first embodiment, namely that of ensuring reliable introduction of the open ends 55 of packages 50 into vacuum chamber 10 and opening 14 (not shown in FIG. 4 because opening 14 is located on the far side of vacuum chamber 10). Rollers 26 can be made from, for example, silicone rubber, nitrile butadiene rubber (NBR), ethylene propylene diene monomer (EPDM) rubber, natural rubber, soft polyvinyl chloride (soft PVC), soft polyurethane with or without fabric reinforcement. The material can have a Shore A hardness of between about 20 and about 100, preferably between about 40 to about 80. Further, rollers 26 can be provided at their peripheral surfaces with a contoured shape having compliant (e.g. soft) properties, such as a surface having projections and/or recesses, grooves, pores, or similar features. The above-mentioned properties of rollers 26 are also applicable to stretch rollers employed in some embodiments instead of stretch belts 80 and 82 (see below). As compared to the guide belts 70 and 72, the material used for stretch rollers and/or stretch belts 80 and 82 generally has a higher coefficient of friction than the material used for the guide belts 70 and 72.

Figure 5:
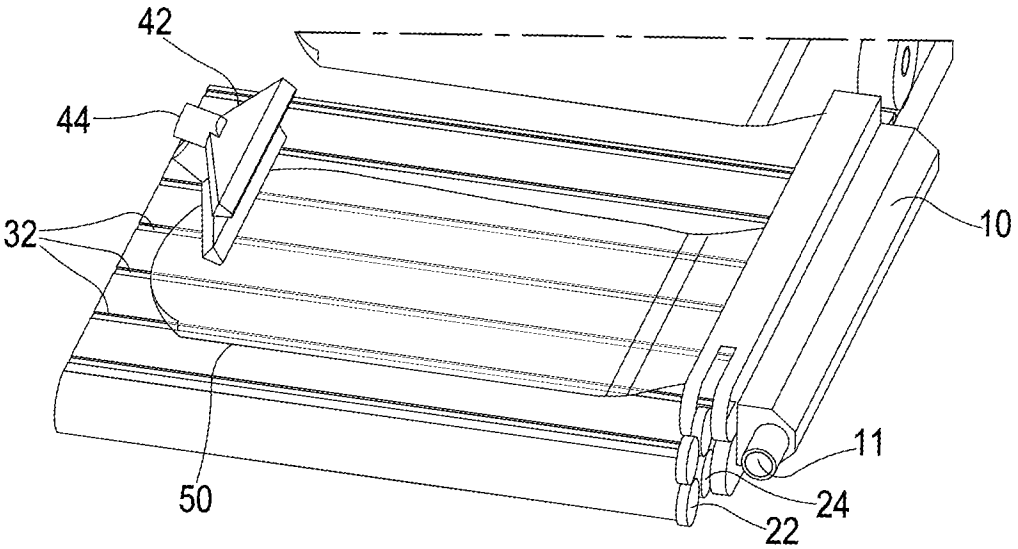
FIG. 5 shows a different view of the second embodiment shown in FIG. 4.

FIG. 5 shows a different view of the second embodiment shown in FIG. 4. Evacuation station 1 as shown in FIGS. 4 and 5 includes a main conveyor belt 30 having grooves 32 (e.g. grooves, notches, channels) formed therein. Further, evacuation station 1 shown in FIGS. 4 and 5 includes hot/cold air blades 42 connected to a corresponding source of hot or cold air at connectors 44. Hot/cold air from hot/cold air blades 42 in connection with grooves 32 present in main conveyor belt 30 may improve the evacuation process in that pockets of air within packages 50 are pushed towards the open end 55 of packages 50 and towards vacuum chamber 10, where the air/gas is evacuated. The grooves 32 can be particularly beneficial in preventing adhesion of film material 21 to the main conveyor 30 and/or adhesion of opposite layers of film material 21. The joint forces of air pressure applied by the hot/cold air blades 42 from outside the packages 50 together with the vacuum applied by the vacuum chamber 10 and the effect of the grooves 32 in the main conveyor belt 30 improve evacuation efficiency, effectiveness, and/or time. Additionally, the grooves 32 can improve the evacuation of air/gas from packages 50 containing products 56 having irregular or inhomogeneous shapes, potentially trapping air/gas between products 56 and film material 21.

Additionally or alternatively to what is described in the previous paragraph, the grooves 32 can be provided with a number of openings (e.g. multiple openings spaced at regular intervals along the length of a single groove) and a vacuum can be applied to a predetermined area of the conveyor belt 30 from below. This can be achieved by providing the lower side of the upper run of the conveyor belt 30 with an aspiration element (e.g. a box-shaped nozzle having an open top portion positioned close to the lower surface of the upper run of the conveyor belt 30) and by applying a vacuum pressure to the aspiration element. In this manner, air can be aspirated through the openings in the upper run of the conveyor belt 30 and, thus, act on the film of packages placed on the conveyor belt 30. Consequently, the film material of the package can be pulled towards the conveyor belt 30 where the film material will adapt to the shape of the upper surface of the upper run of the conveyor belt 30. Thereby, the film is pulled into the grooves 32, forming plies or wrinkles in the film material.

This deformation of the film material entails several effects promoting efficient and effective evacuation of the package. First, the plies or wrinkles form channels below the product placed in the package and thereby facilitate evacuation of air in a region of the package difficult to evacuate, because it is often not or not entirely in fluid communication with the open end of the package due to the product being placed upon it. Further, even if the region is in fluid communication with the open end of the package, this might be only indirectly and/or through passages having a rather high resistance to fluid flow (e.g. due to complex and/or twisted shapes of the passages, small minimal or average diameter of the passages, points of constriction in the passages). The channels formed below the product conform to the straight shape and diameter of the grooves and, therefore, provide improved fluid communication. Second, the channels can provide an additional general region of fluid flow from the sealed end of the package towards the open end thereof, in addition to the regions at the top of the product and on either side thereof, where the packaging film is typically spaced further from the product than at the bottom thereof. And third, the channels can carry over towards the open end and through the opening 14 into the vacuum chamber 10, such that the channels promote the overall evacuation of the package by ensuring that opposite layers of film do not adhere too closely to one another in the region where the film material extends through the opening 14 into the vacuum chamber 10.

Figure 6:
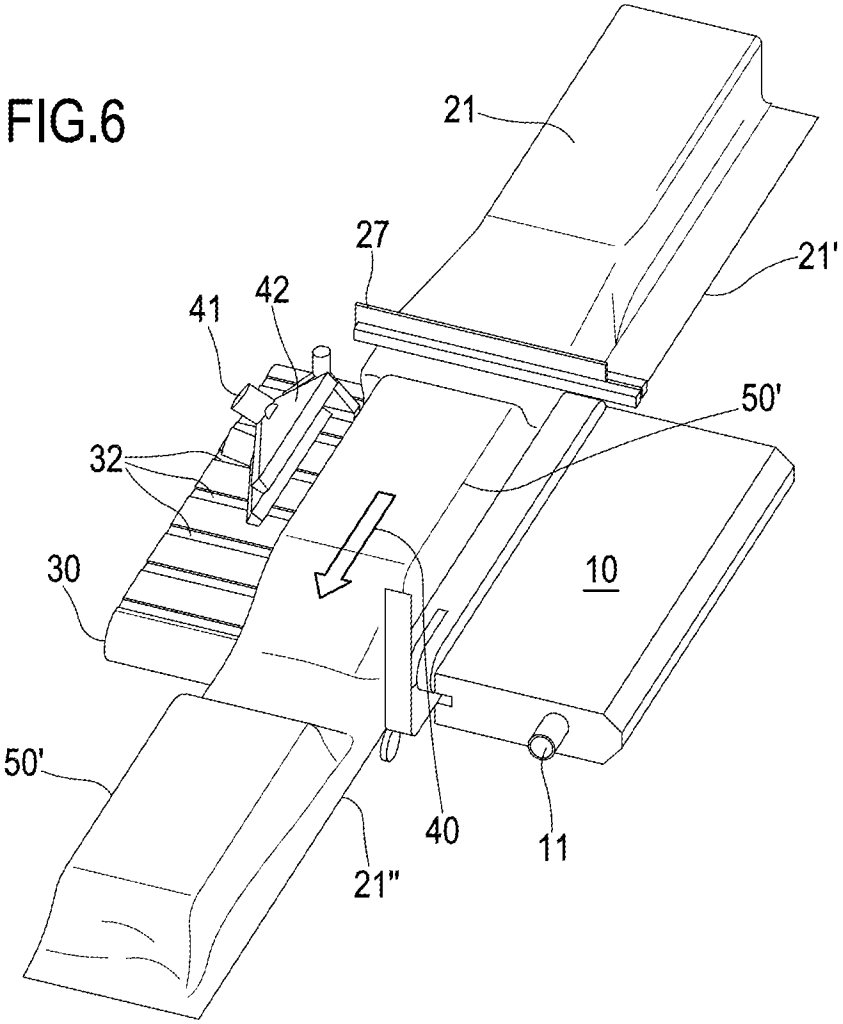
FIG. 6 shows a third embodiment of an evacuation station of a packaging apparatus according to the present invention.

FIG. 6 shows a third embodiment of an evacuation station of a packaging apparatus according to the present invention. In the third embodiment, packages 50' are prepared by placing products 56 onto a sheet of film 21 which is subsequently folded over products 56 in order to form a tubular film having an unsealed (or open) edge 21' extending along the length of the tubular film. Before evacuation, sealing bars 26 and 27 are actuated in order to provide the tubular film with transversal seals (transversal denoting a direction perpendicular to the movement direction 40 and parallel to an upper surface of main conveyor belt 30), thereby sealing each product 56 from a subsequent product 56. Upon entry into evacuation station 1, therefore, tubular film 21 holds products 56 in packages 50' such that the insides of packages 50' are separated from one another by transversal seals but still connected to one another by film material 21. At the same time, each package 50' has an open end in correspondence of the unsealed edge 21' extending along the length of each package 50'. The packages 50' being arranged and transported through evacuation station 1 in this manner, the unsealed edge 21' can be easily fed into vacuum chamber 10 in a continuous way, such that evacuation of packages 50' can be performed as described above with respect to the first and second embodiments. Sealing of edge 21' is performed in the same manner as in the first and second embodiments, for example using sealing rolls 24.

After exiting evacuation station 1, packages 50' have been evacuated and sealed along the previously unsealed edge 21', thereby being provided with a sealed edge 21". Subsequently, packages 50' can be separated further downstream of evacuation station 1, for example at a corresponding cutting station (not shown). In some applications, it is desired to keep packages 50' connected to one another. In such applications, instead of separating the packages 50' using a cutter, merely a perforation is provided between two adjacent seals, so that products 50' may be separated manually by ripping the film material 21 along the perforation.

Figure 7:
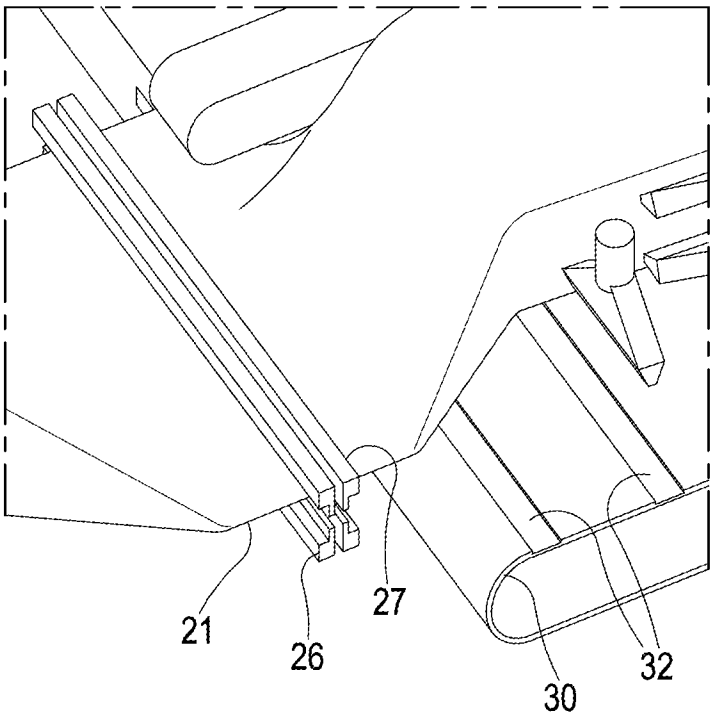
FIG. 7 shows a different view of the third embodiment shown in FIG. 6.

FIG. 7 shows a different view of the third embodiment shown in FIG. 5. Sealing bars 26 and 27 are typically provided in a configuration that allows the formation of two transversal seals in a single operating cycle, thereby providing a first package with a trailing seal and a second subsequent package with a leading seal. This is beneficial if the packages are subsequently separated from one another using a cutter or if they are provided with a perforation (see above). In some embodiments, sealing bars 26 and 27 also include a cutting means (or perforating means), such that packages 50' can be sealed and cut (or perforated) within a single operating cycle of sealing/cutting/perforating bars 26 and 27. In these embodiments, packages may enter evacuation station 1 package by package already separated and not in a continuous tubular film where packages 50' are separated further downstream.

Figure 8:
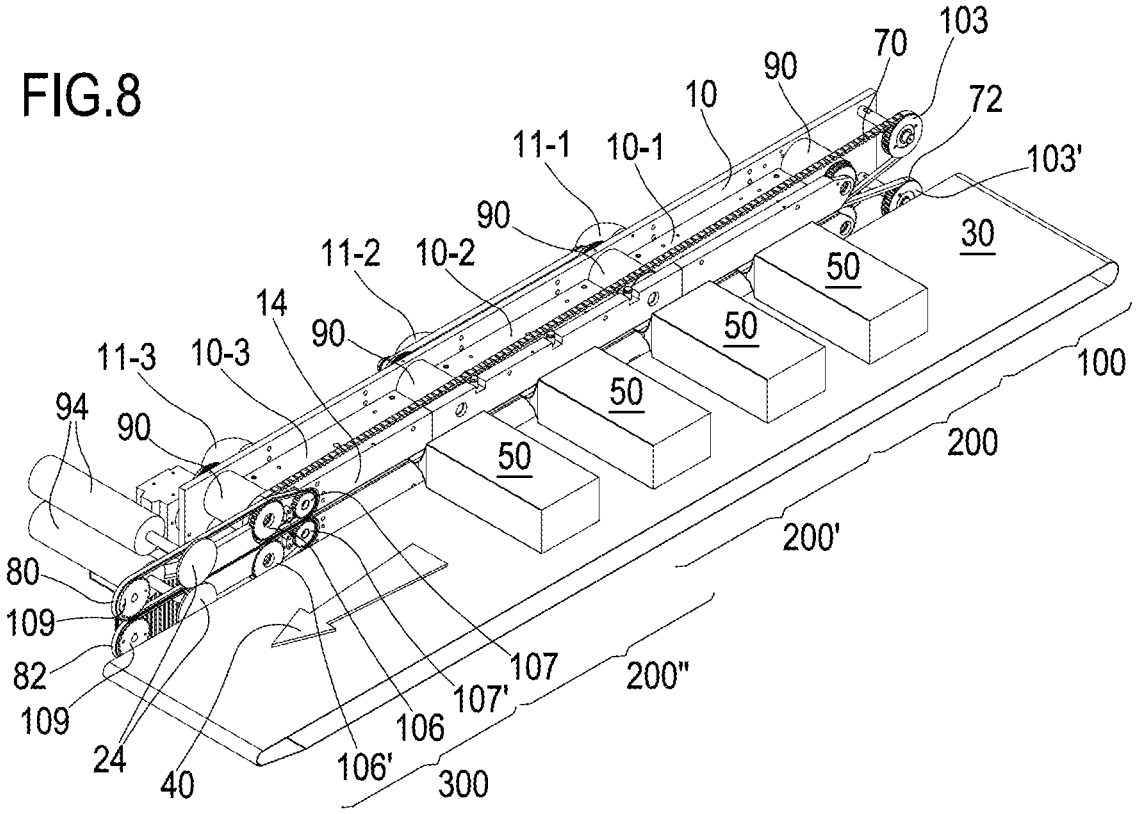
FIG. 8 shows an isometric front view of a fourth embodiment of an evacuation station of a packaging apparatus according to the present invention.

FIG. 8 shows an isometric front view of a fourth embodiment of an evacuation station 1 of a packaging apparatus according to the present invention. It is noted that the movement direction 40 of packages 50 through evacuation station 1 in FIG. 8 is from the upper right of the figure towards the lower left. The evacuation chamber 1 according to the third embodiment also has a conveyor 30 configured to move package 50 along a main movement direction 40 towards, through, and away from evacuation station 1. The evacuation station has a vacuum chamber 10 including, merely as an example, three sections, namely a first section 10-1, a second section 10-2, and a third section 10-3. It is understood that vacuum chamber 10 can include any desired number of sections based on the desired functionality thereof. In the third embodiment shown in FIG. 8, vacuum chamber 10 has a first section 10-1 defining an operating section 200, a second section 10-2 defining an operating section 200', and a third section 10-3 defining an operating section 200". Further, evacuation station 1 has an intake section 100 and an outlet section 300. Packages 50 are introduced into evacuation station 1 at the intake section 100, where guide belts 70 and 72 contact the neck of packages 50 in order to feed the neck into the vacuum chamber 10.

Upper guide belt 70 and lower guide belt 72 are guided along the vacuum chamber 10 in correspondence of and along the opening 14 in respective grooves or notches 70' and 72' (not shown in FIG. 8). Further, belts 70 and 72 are actuated substantially in sync with conveyor belt 30, such that packages 50 move along conveyor belt 30 at substantially the same speed as the necks of the packages 50 are guided between the upper belt 70 and the lower belt 72 along opening 14—or vice versa. It is understood that both conveyor 30 and belts 70 and 72 are provided with one or more actuators connected to a control unit configured to control the one or more actuators in order to a desired synchronous or substantially synchronous movement, or any movement required during operation of evacuation station 1. The guide belts 70 and 72 may comprise one or more of the following materials: polyvinylchloride (PVC), polyurethane (PU), polyethylene (PE), Teflon. In particular, the guide belts 70 and 72 may be made from PVC, PU, Teflon coated PU and PE fibrous web. It is noted that generally the material of the guide belts 70 and 72 is selected to exhibit a comparably low coefficient of friction, as compared, for example, to stretch belts 80 and 82 (see below). In order to optimize for wear and tear and/or cost, the material of the guide belts 70 and 72 may be further modified or selected.

Evacuation station 1 is configured to move package 50 from the intake section 100 through each of operating sections 200, 200', and 200", and subsequently through outlet section 300 in a manner that allows for the neck of packages 50 to be introduced into vacuum chamber 10, and through each of sections 10-1, 10-2, and 10-3. The sections 10-1, 10-2, and 10-3 are separated by upper rollers 90 and lower rollers 92 (lower rollers are not shown in FIG. 8). It is understood that lower rollers 92 are substantially in contact with or nearly in contact with upper rollers 90, thereby defining contact sections opposite to one another and configured to contact opposite sides of film 21 in the region of the neck of each package 50 being moved through vacuum chamber 10. Further, rollers 90 and 92 provide a divider between sections 10-1, 10-2, and 10-3, as well as towards the outside at the respective ends of vacuum chamber 10 (see intake section 100 and outlet section 300).

Corresponding actuators are configured to actuate rollers 90 and 92 are substantially in sync with belts 70 and 72, as well as conveyor belt 30, such that packages 50 move along conveyor belt 30 at substantially the same speed as the necks of the packages 50 are guided between the upper and lower rollers 90 and 92, as well as between the upper and lower belts 70 and 72 along opening 14. It is understood that both conveyor 30, belts 70 and 72, and rollers 90 and 92 are provided with one or more actuators connected to a control unit configured to control the one or more actuators in order to a desired synchronous or substantially synchronous movement, or any movement required during operation of evacuation station 1. In some embodiments, belts 70 and 72, and rollers 90 and 92 are actuated by a single common drive motor. In other embodiments, belts 70 and 72, and rollers 90 and 92 are driven by two or more actuators commonly controlled by the control unit.

FIG. 8A shows a cross section view of a conveyor belt 30 in accordance with embodiments of the invention. The cross section view is taken along a plane that extends along the movement direction 40 and perpendicular to a surface plane of the conveyor belt 30. The conveyor belt 30 includes a plurality of recesses 30*r* and projections 30*p*, the projections extending along the width of the conveyor belt 30 (i.e. perpendicular to the movement direction 40). The ratio between the sizes of the projections and the recesses is configured to reduce the contact area between the packages 50 carried by the conveyor 30 and the conveyor belt 30. In the embodiment shown, the projections are provided in form of ridges or bands extending perpendicularly to the movement direction 40. Reducing the contact area between the packages 50 and the conveyor belt 30 may significantly reduce friction between the packages 50 and the conveyor belt 30 in a direction parallel to a main development direction of the projections 30*p* (i.e. substantially transversal to the movement direction 40). This configuration allows the packages 50 to move in the direction parallel to the main development direction of the projections 30*p* with less resistance than in the movement direction 40. On one hand, the conveyor belt 30 is configured to offer sufficiently high friction between the packages 50 and the conveyor belt 30 along the movement direction 40 in order to ensure reliable transportation of packages 50. On the other hand the conveyor belt 30 is configured offer sufficiently low friction between the packages 50 and the conveyor belt 30 in a direction substantially transversal to the movement direction 40 in order to allow the packages 50 to relatively move with respect to the evacuation chamber 10 (e.g. to laterally move with respect to the movement direction 40). This is beneficial since during one or more of the process steps (e.g. flushing, evacuation), an inner volume of the packages 50 may change and, thus, require a package 50 to accommodate a shift in position towards, or away from, the evacuation chamber 10. In some embodiments, the movement means 30 may be provided with rollers allowing the packages to move laterally with respect to the movement direction. Such embodiments may provide little to no resistance to lateral movements of the packages during the different processing stages (e.g. flushing, evacuation).

Generally, the conveyor belt 30 includes from about 20% to about 50% projections 30*p* and from about 80% to about 50% recesses 30*r* per surface unit. A ratio of surface area covered by the recesses 30*r* to surface area covered by the projections 30*p* ranges from about 1:1 to about 1:5. In a preferred embodiment of the conveyor belt 30 as shown in FIG. 8A, the conveyor belt 30 includes about 30% projections 30*p* and about 70% recesses 30*r* per surface unit. It is noted that depending on individual process properties and/or applications (e.g. size and/or weight of packages 50, types of film 52, properties of the evacuation/flushing, etc.), different configurations of projections 30*p* and recesses 30*r* may be preferred. In some embodiments, the projections may be provided with a contact portion that has one or more of the following properties: high wear resistance, a friction coefficient that is higher along the length of the projections than perpendicular thereto, and easy to clean.

Figure 9:
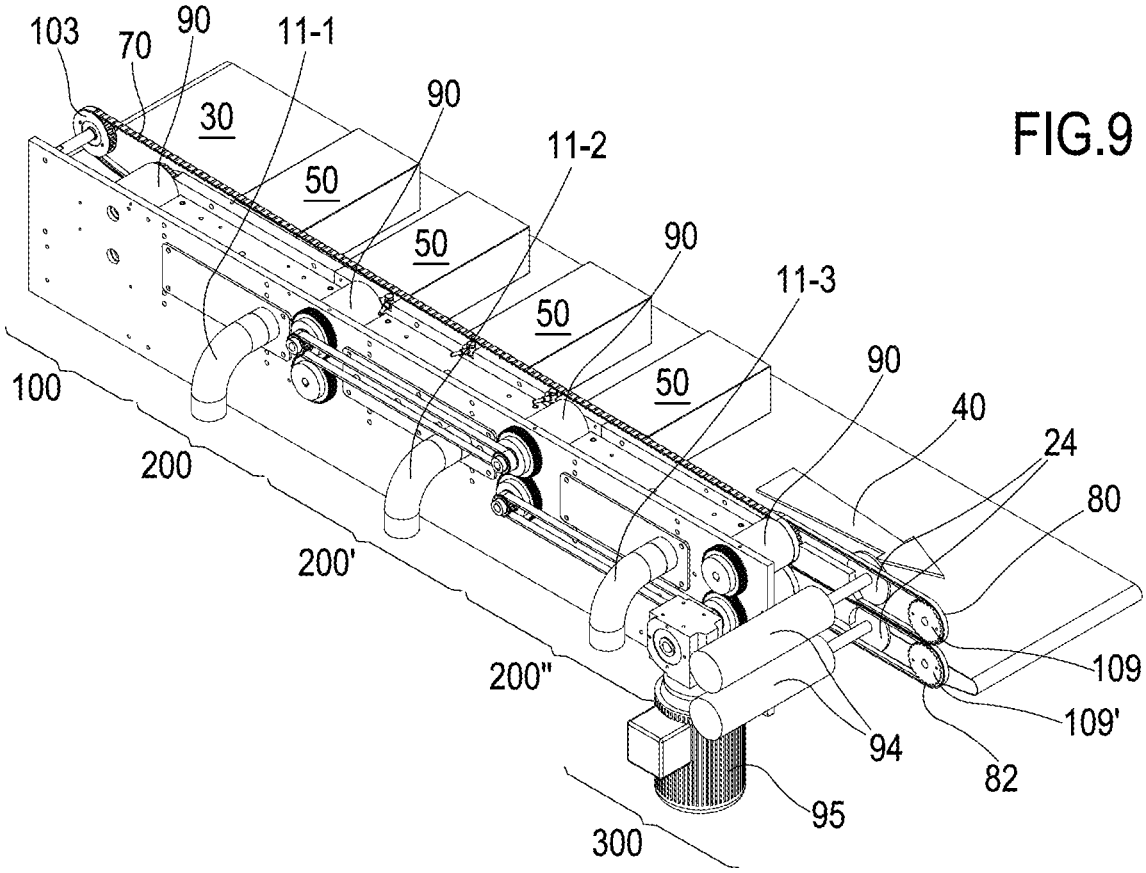
FIG. 9 shows an isometric back view of the fourth embodiment of an evacuation station of a packaging apparatus according to the present invention.

FIG. 9 shows an isometric back view of the fourth embodiment of an evacuation station of a packaging apparatus according to the present invention. FIG. 9 shows the drive system including drive motor 95 and several transmission belts on the rear side of evacuation station 1. In the fourth embodiment, belts 70 and 72 as well as rollers 90 and 92 are driven by a single common drive motor 95. Transmission belts or chains are provided at the rear of evacuation 1 and are configured to transfer mechanical power from the drive to respective rollers or sprockets, which in turn actuate further components, such as belts 70 and 72.

Further, the rear of evacuation station 1 is provided with three separate fluid connectors 11-1, 11-2, and 11-3, each of the fluid connectors being configured to connect to a vacuum source. It is noted that in some embodiments each fluid connector can be connected to a separate vacuum source providing a specific vacuum pressure different from one another. In other embodiments, all fluid connectors can be connected to a single vacuum source via a respective conduit, each conduit optionally including a flow controller configured to supply the fluid connector with a respective and/or predetermined vacuum pressure. In this manner, the first section 10-1 of evacuation chamber 10 can be supplied with a vacuum pressure different from that supplied to the second and/or third sections of the vacuum chamber 10. It is noted that some applications require a progressive evacuation of the package 50, during which each package is evacuated in several stages, each stage providing a package with a vacuum pressure higher than previous stages. In other applications, one of the sections 10-1, 10-2, or 10-3 can be provided not with a vacuum pressure but instead with a positive pressure and a suitable gas (e.g. an inert gas such as $CO_2$) in order to facilitate flushing the package with the gas before evacuation or between evacuations.

Figure 10A:
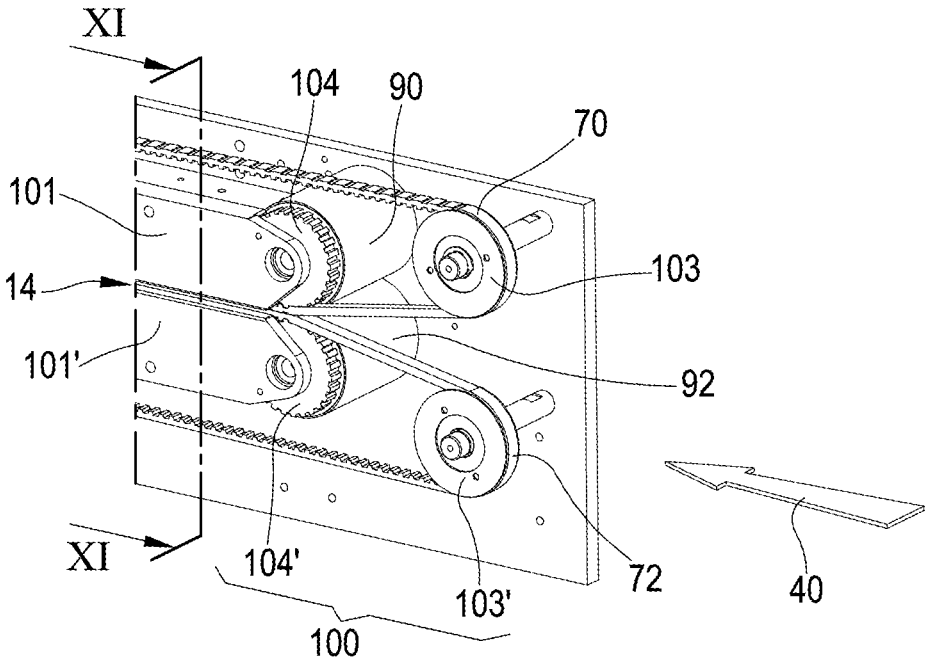
FIGS. 10A, 10B, and 10C show detailed views of an intake section of an evacuation station according to the present invention.
Figure 10B:
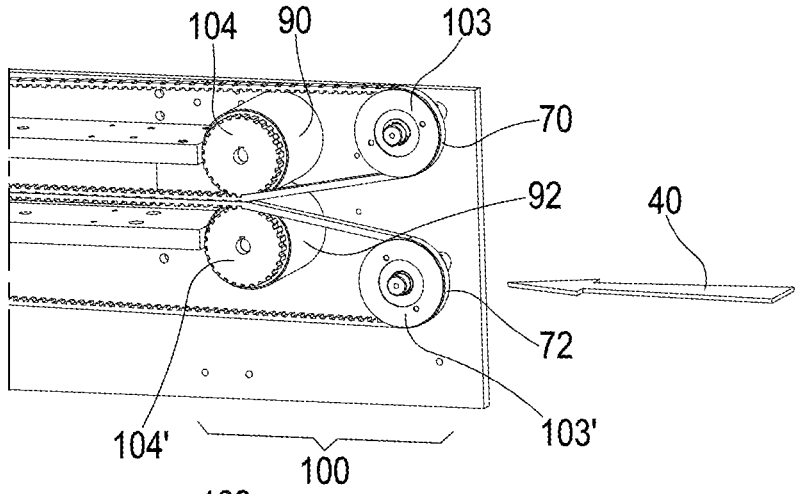
Figure 10C:
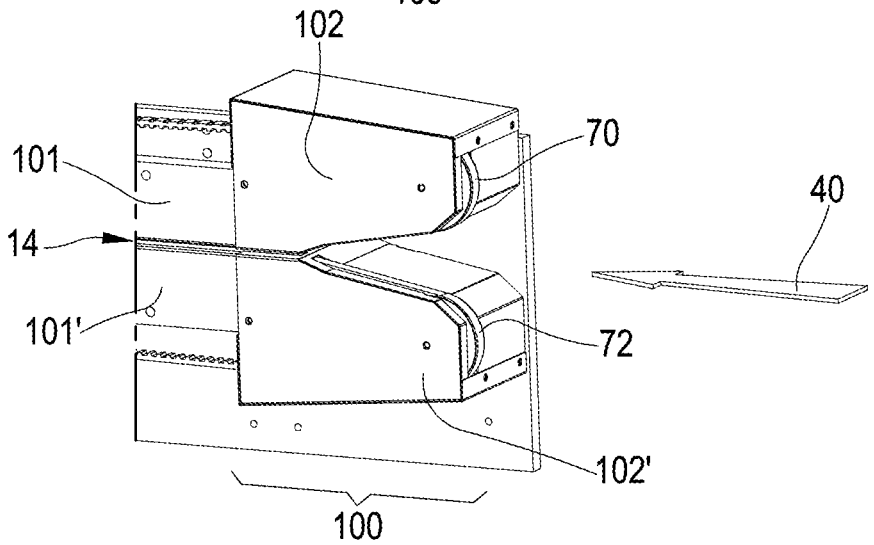

FIGS. 10A, 10B, and 10C show detailed views of an intake section of an evacuation station according to the present invention. FIG. 10A shows the intake section 100 without any cover in order to illustrate the mechanical structure of the components and the configuration of the belts 70 and 72. FIG. 10A shows upper and lower supports 101 configured to support rollers 90 and 92, respectively. Rollers are provided with upper and lower gears or sprockets 104 and 104' configured to engage belts 70 and 702, respectively. Further, the intake section 100 is provided with upper and lower deflection gears or sprockets 103 and 103' configured to provide, in combination with gears 104 and 104', belts 70 and 72 with an angular configuration suitable for gradually engaging the neck of a package 50 being introduced into the intake section 100 of evacuation station 1 in movement direction 40. As shown, gears 104 and 103 are spaced and positioned such that belt 70 is guided over upper deflection gear 103 and upper gear 104 and extends in the region of the intake section 100 generally along the movement direction 40 and angularly downwards towards opening 14. Likewise, gears 104' and 103' are spaced and positioned such that belt 72 is guided over lower deflection gear 103' and lower gear 104' and extends in the region of the intake section 100 generally along the movement direction 40 and angularly upwards towards opening 14. Belts 70 and 72, thus, form a wedge-shaped configuration along the intake section 100, in which the distance between belts 70 and 72 decreases along the movement direction 40, each belt being guided around deflection gear 103 and 103', respectively, and converging towards one another in direction of opening 14.

Supports 101 and 101' and/or rollers 90 and 92 are configured to maintain the contact surfaces of rollers 90 and 92 substantially in contact with one another, without excessive pressure being created between the contact surfaces. Preferably, the supports 101 and 101' and/or rollers 90 and 92 are configured to keep the contact surfaces in contact with one another with sufficient contact force in order to provide the interface extending between and along the contact surfaces (e.g. an elongated area extending along the side walls of the substantially cylindrically-shaped rollers 90 and 92 and substantially parallel to the longitudinal axes thereof) with an air-tight seal, while the contact force is minimized in order to allow the film 21 of the neck of a package 50 to pass between rollers 90 and 92.

Further, gears 104 and 104' are configured to bring belts 70 and 72 as close together as possible without bringing respective contact surfaces of the belts 70 and 72 into direct contact with one another. Generally, vacuum chamber 10 and respective gears 104 and 104' arranged along the length of the vacuum chamber 10 are configured to position adjacent longitudinally extending portions of belts 70 and 72 substantially parallel to one another. Preferably, the adjacent portions of belts 70 and 72 are spaced apart from one another at a distance of 0.8 mm or less, more preferably at a distance of 0.5 mm or less, and most preferably at a distance of 0.3 mm or less.

FIG. 10B shows the intake section 100 without any cover and without supports 101 and 101' in order to illustrate the mechanical structure of further components and the configuration of the belts 70 and 72. In FIG. 10B the structure carrying the opening 14 has been removed in order to show the substantially parallel configuration of adjacent portions of belts 70 and 72. Between gears 104 and 104' arranged in correspondence of the intake section 100 of evacuation station 1 and gears 104 and 104' arranged in correspondence of the outlet section 300 of evacuation station 1, adjacent portions of belts 70 and 72 extend substantially parallel to one another as described above. In the embodiment shown, supports 101 and 101' are spaced and positioned with respect to one another so that the opening 14 is defined as a longitudinally extending slot and/or notch or groove.

Further, gears 104 and 104' are shown as sprockets or gears having teeth engaging a corresponding profile present in belts 70 and 72, respectively. Gears 104 and 104' may be configured to impart motion transferred to them from a drive motor (e.g. from drive motor 95, possibly via transfer belts or chains; see FIG. 9) onto belts 70 and 72, respectively. To this aim, gears 104 and 104' may exhibit a suitable cogging or teething corresponding to a profile present in belts 70 and 72. In an alternative, gears 104 and 104' may exhibit a circumferentially extending groove configured to frictionally engage a v-belt shape of belts 70 and 72. It is understood that other alternatives for imparting movement to belts 70 and 72 can be employed at any one of gears 70 and 72. Further, deflection rollers 103 and 103' can additionally or alternatively be configured to impart movement to belts 70 and 72 in a similar manner as described above with respect to gears 104 and 104'.

FIG. 10C shows the intake section 100 with covers 102 and 102' as well as supports 101 and 101' being in place over belts 70 and 72. Covers 102 and 102' ensure that the majority of moving parts in intake section 100 are covered in order to provide for operational safety. As can be seen from FIG. 10C, covers 102 and 102' are shaped to conform to the wedge-shaped configuration of belts 70 and 72 in intake section 100, such that belts 70 and 72 can engage the film 21 of the necks of packages 50 being introduced into evacuation station 1 in order to guide the film material into ant through vacuum chamber 10.

Figure 10D:
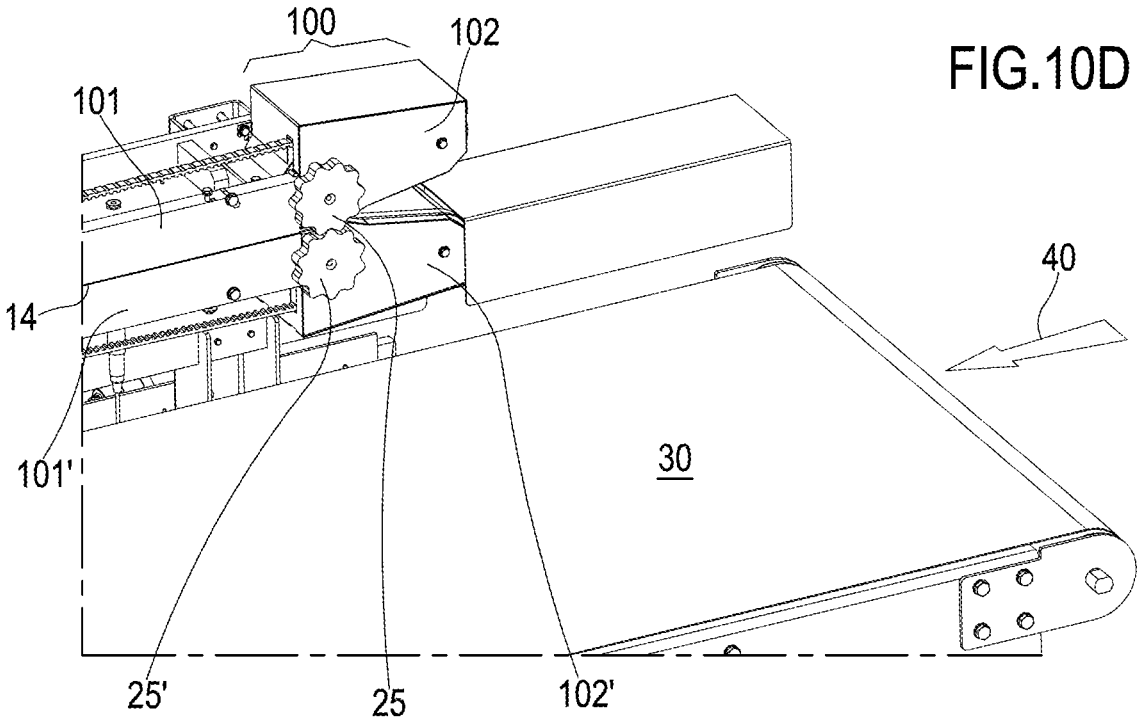
FIG. 10D shows an isometric front view of an intake section of an evacuation station according to the present invention.

FIG. 10D shows an isometric front view of an intake section 100 of an evacuation station according to the present invention. In addition to the structure described above, the intake section 100 can include a means for generating wrinkles, for example in the form of a set of shaped wheels 25 and 25' as shown in FIG. 10D. The basic principle of any means for generating wrinkles is that a package 50 having a perfectly flat bag neck may create difficulties for the different process stages, for example flushing, evacuation. In this respect, it can be beneficial to provide the bag neck of each package 50 with a controlled set (e.g. with respect to size, shape, number, etc.) of wrinkles in order to provide the bag neck of each package with channels along the wrinkles, which facilitate flushing and/or evacuation. As shown in FIG. 10D, this can be achieved by providing the intake section with a set of shaped wheels 25 and 25' that are positioned at the intake section and proximal to the vacuum chamber 10. An upper wheel 25 is arranged engaging an opposite a lower wheel 25' such that the plastic film of a bag neck of a package 50 being introduced into the vacuum chamber 10 is made to conform to the individual shape of the wheels 25 and 25'. In this manner, the film of the bag neck assumes an undulating configuration as it is introduced into the opening 14 and between belts 70 and 72. Due to the film of the bag neck being held between belts 70 and 72, the undulating configuration is compressed without a substantial extension and, thus, flattening of the film material, thereby resulting in a number of wrinkles being present at the bag neck as long as it is held between belts 70 and 72, that is during the following processing stages (e.g. flushing, evacuation). The individual properties of the wrinkles can be controlled based on the shape (and corresponding counter shape) of the shaped wheels 25 and 25'.

Figure 10E:
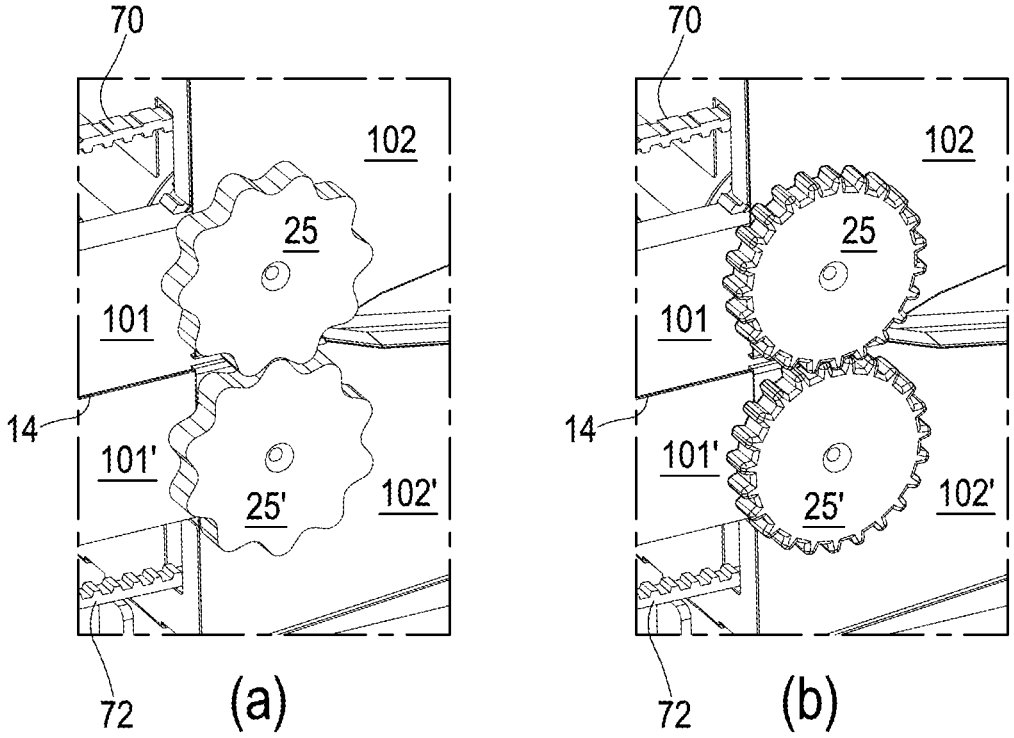
FIG. 10E shows a detailed isometric front view of an intake section of an evacuation station according to the present invention.

FIG. 10E shows a detailed isometric front view of an intake section 100 of an evacuation station according to the present invention. What is shown on the left side of FIG. 10E is a detailed view of the intake section 100 shown in FIG. 10D where the engagement between the shaped wheels 25 and 25' and the arrangement thereof is shown in more detail. The wheels 25 and 25' shown on the left are arranged at a downstream end of the intake section 100 in terms of the movement direction 40 such that the wrinkle generation is performed while the bag neck of a package 50 being processed has not yet been introduced into the opening 14. Further, the wheels 25 and 25' are positioned proximate to the vacuum chamber 10 such that the bag neck of a package 50 being processed has not enough time to straighten and/or flatten again while the package 50 is being conveyed by the means for moving 30. The shaped wheels 25 and 25' may be synchronized with the movement of belts 70 and 72 such that a controlled handover of the bag neck of a package 50 into the opening 14 and, thus, to belts 70 and 72 is facilitated. In some embodiments, the wheels 25 and 25' are coupled to the drive system driving belts 70 and 72 by corresponding sprockets or cogs (not shown).

The wheels 25 and 25' shown on the right side of FIG. 10E illustrate an alternative example for the individual shape of the wheels 25 and 25'. Depending on a number of parameters (e.g. including film thickness, film composition, size of packages, weight of products processed, etc.), the individual shape of wheels 25 and 25' may be selected in order to achieve the desired generation of wrinkles. For example, thinner film material and/or packaging of smaller or lighter products may require shaped wheels 25 and 25' having a rather moderate undulating shape (e.g. as shown on the left of FIG. 10E and in FIG. 10D). In other applications involving, for example, thicker film material and/or packaging of larger or heavier products may require shaped wheels 25 and 25' having a more pronounced or coarse undulating shape (e.g. as shown on the right of FIG. 10E). It is noted that the individual shape of shaped wheels 25 and 25' may be selected based on the individual packaging application and, thus, may vary with respect to the examples shown in FIGS. 10D to 10F. It is further noted that the individual placement of wheels 25 and 25' is largely independent from the individual shape of wheels 25 and 25' such that the generation of wrinkles is substantially effected immediately prior to the bag neck of a package 50 being introduced into the opening 14 and between belts 70 and 72.

FIG. 10F shows an isometric front view of an alternative embodiment of an intake section 100 of an evacuation station according to the present invention. In this example, the means for generating wrinkles includes two power wheels 25 and 25', which in the illustrated embodiment are operated at a slightly increased speed with respect to the speed of belts 70 and 72. The difference in speed between the wheels and the belts leads to the film material of the bag neck of a package 50 being pushed towards the opening 14 and between belts 70 and 72 at a higher speed than the wrinkled bag neck is transported further downstream. In this manner, the film material is provided with an undulating configuration just prior to being gripped by belts 70 and 72. In this embodiment, the speed of the power wheels 25 and 25' can be individually adjusted in order to achieve the desired generation of wrinkles. In general, a higher difference in speed between the wheels 25 and 25' and the belts 70 and 72 will result in a larger number of wrinkles and/or in larger wrinkles. As noted above, further properties of the packaging application (e.g. including film type and thickness, package size and weight, etc.) can be taken into account in order to achieve a desired result.

FIGS. 11A and 11B show cross sections of upper and lower belts as employed in the fourth embodiment of an evacuation station according to the present invention. The cross sections in FIGS. 11A and 11B are taken along the dashed line XI-XI as shown in FIG. 10A. FIG. 11A is based on a cross section plane oriented substantially parallel to the longitudinal extension of adjacent portions of belts 70 and 72, i.e. substantially parallel to the movement direction 40. FIG. 11B is based on a cross section plane oriented substantially perpendicular to the longitudinal extension of adjacent portions of belts 70 and 72, i.e. substantially perpendicular to the movement direction 40.

FIG. 11A shows a longitudinal cross section of a first embodiment of belts 70 and 72, where belt 70 has an outer surface 70*o* and an inner surface 70*i*; the terms "outer" and "inner" referring to a relative position with respect to a circular path of a respective belt around gears and/or sprockets. As shown on the upper side of belt 70 in FIG. 11A, the inner surface 70*i* is contoured and has a shape configured to engage corresponding gears and/or sprockets, for example gear 104. The inner surface 70*i* of the belt 70 is configured to allow for the belt 70 to be driven by a corresponding drive motor via corresponding gears (e.g. including drive 95 and gear 104). As shown on the lower side of the belt 70 in FIG. 11A, the outer surface 70*o* is contoured such as to define recesses 73 and/or projections forming channels. The recesses or channels 73 are preferably laterally extending channels running substantially perpendicular to the longitudinal extension of the belt 70, and, thus, putting the inside of vacuum chamber 10 in fluid communication with an outside atmosphere. In one embodiment, the outer surface 70*o* includes recesses having a depth of about 1 mm and a length of 5 mm, with a distance of 10 mm between successive recesses.

As shown in FIG. 11A, the belt 72 has an outer surface 72*o* and an inner surface 72*i*. The inner surface 72*i* shown on the lower side of the belt 72 in FIG. 11A has a contour corresponding to that described above with respect to the inner surface 70*i* of the belt 70. The inner surface 72*i* is contoured and has a shape configured to engage corresponding gears and/or sprockets, for example gear 104'. The inner surface 72*i* of the belt 72 is configured to allow for the belt 72 to be driven by a corresponding drive via corresponding gears (e.g. including drive 95 and gear 104'). As shown on the upper side of the belt 72 in FIG. 11A, the outer surface 72*o* is substantially flat, without any recesses or projections. The embodiment shown in FIG. 11A, thus, illustrates an embodiment in which outer surface 70*o* of the belt 70 is provided with recesses and the outer surface 72*o* of the belt 72 is substantially flat. It is, however, noted that alternatively, in a second embodiment not shown in FIGS. 11A and 11B, the outer surface 72*o* of the belt 72 can be contoured and the outer surface 70*o* of the belt 70 can be substantially flat. Further, belts 70 and 72 can both have the same outer surfaces, for example both flat (not shown in FIGS. 11A and 11B) or both contoured (not shown in FIGS. 11A and 11B), and, if both outer surfaces 70*o* and 72*o* are contoured, the outer surfaces 70*o* and 72*o* can have the same or different contours.

In order to facilitate and/or to promote the formation of wrinkles during introduction of necks of packages 50 into evacuation station 1 it has proven beneficial to provide the outer surface 70*o* of the belt 70 with a contoured shape as described above (preferably with recesses having a depth of about 1 mm and a length of 5 mm, with a distance of 10 mm between successive recesses), while the outer surface 72*o* of the belt 72 is provided with a substantially flat contour. This configuration provides channels 73 as shown in FIG. 11A having substantially the size of the recesses formed in outer surface 70*o*. This configuration in particular facilitates and/or promotes that opposing layers of film material 21 (i.e. at the neck of packages 50) being introduced into the region between the belts 70 and 72 are not evenly aligned or pushed against one another, thereby creating a contact region between opposing layers of film 21 largely or substantially sealing the package, but are instead gently held in a manner allowing for the opposing layers of film 21 to separate from one another at least in the region of the channels 73. These regions where opposing layers of film 21 are allowed to become separated are important for an efficient and/or effective evacuation of the packages 50 due to the regions allowing for the air or gas present within the packages to exit the package. The above-described combination of a contoured outer surface 70*o* and a flat outer surface 72*o* enables wrinkles in film 21 to be created in correspondence of the channels 73. It is noted that the formation of wrinkles can be further supported or facilitated by providing the packages 50 with corresponding film material 21. Thinner or more rigid film material may promote the formation of wrinkles. Additionally or alternatively, the film material 21 can be provided with a structure or texture (e.g. grooves, meshes, recesses, projections, variation in thickness or rigidity) in order to support or facilitate the formation of wrinkles. In some embodiments, the film material is provided with predetermined folding structures (see above) at which the film material 21 can initiate the formation of wrinkles. The structure or texture can be provided on the inside and/or on the outside of the film material 21.

As shown in FIG. 11B, support 101 includes a groove or notch 1010 configured to accommodate and/or guide the belt 70 in correspondence of the opening 14 along the length of the vacuum chamber 10. Likewise, support 101' includes a groove or notch 1010' configured to accommodate and/or guide the belt 72 in correspondence of the opening 14 along the length of the vacuum chamber 10. It is noted that both grooves 1010 and 1010' are sized and shaped to correspond to the upper portion of the cross section of the belts 70 and 72, respectively in order to provide lateral guidance and substantially sealing (e.g. air-tight) contact along the respective groove while minimizing friction and allowing for some limited vertical and/or lateral movement of the belts 70 and 72.

Limited vertical movement of the belts 70 and 72 can be beneficial in accommodating films 21 of different thicknesses without exerting excess pressure (e.g. substantially no pressure) upon layers of film 21 (not shown in FIG. 11B) being fed through evacuation station 1. Limited lateral movement of the belts 70 and 72 can be beneficial in accommodating movement of layers of film 21 (not shown in FIG. 11B) during introduction into the vacuum chamber 10 and during evacuation and/or flushing. Limited vertical and/or lateral movement can further be beneficial with respect to reducing friction of the belts 70 and 72 created during relative movement with respect to grooves 1010 and 1010', respectively. It is noted that during evacuation of packages 50 in evacuation station 1, the packages 50 and the film material tends to move towards the vacuum chamber 10, due to the evacuation being performed and/or due to the pressure differential between the pressure inside of the vacuum chamber 10 and the ambient pressure. Therefore, the belts 70 and 72 have to be configured to accommodate limited movement of the film 21 between the adjacent portions of the belts 70 and 72.

Channels 74 provided in supports 101 and 101' can be employed in order to adjust a pressure exerted between adjacent portions of the belts 70 and 72. As described above, generally the adjacent portions of the belts 70 and 72 should exert little or no pressure on layers of film 21 positioned between the belts 70 and 72. However, in some applications and/or some stages of evacuation, it can be beneficial to enhance the sealing contact between the adjacent portions of the belts 70 and 72, for example during flushing, in order to minimize loss of inert gas. In order to enhance the sealing contact, pressurized air can be introduced through channels 74, thereby forcing the adjacent portions of the belts 70 and 72 against one another, depending upon the pressure of the air provided. As each channel 74 has a rather local effect on a respective section of one of the belts 70 and 72 (e.g. being effective along a section of 5 to 10 cm), the individual pressure and/or duration can be set and/or modulated as desired.

FIG. 12A shows the inside of a flusher chamber that can be employed with an evacuation station according to the present invention. In FIG. 12A, any covers and/or supports have not been illustrated in order to show the components inside and the structure of the flusher chamber 10-*xf*. The flusher chamber 10-*xf* can be employed generally in any of the operating sections 200, 200' and 200". However, typically the flusher chamber is used in the second operating section 200' after an initial evacuation stage (e.g. at operating section 200; see FIGS. 8 and 9) and before a final evacuation stage (e.g. operating section 200"). Providing a package 50 to be evacuated with an initial vacuum in a first operating section 200, and then flushing the package 50 with an inert gas (e.g. $CO_2$) in a second operating section 200' before providing the package 50 with a final vacuum in a third operating section 200" can efficiently and effectively reduce the oxygen content within the package to a very low level, preferably a level below about 1%, more preferably to a level below 0.5%. In order to open the bag necks of packages 50 being moved along the flusher chamber 10-*xf*, or in order to keep such bag necks open, several means can be applied, including, but not limited to, air blades, static loading, pressure difference, and/or combinations thereof. This also applies to the embodiment shown in FIGS. 1 to 3 and to the embodiment shown in FIGS. 6 to 7.

The flusher chamber 10-*xf* includes one or more nozzles 120 configured to provide the flusher chamber 10-*xf* with an inert gas from a corresponding source (not shown). The flusher chamber 10-*xf* can further include a fluid connector 11-*x* configured to connect to a suitable conduit and/or further components (e.g. a vacuum source, a pump) in order to facilitate selective aspiration of gas or air from the flusher chamber 10-*xf*, for example when venting superfluous gas from the flusher or when providing a controlled outflow of gas from flusher chamber 10-*xf*. Nozzles 120 can be fixedly integrated into the flusher chamber 10-*xf* or the nozzles 120 can be movable towards and away from the opening 14 (i.e. laterally with respect to movement direction 40) in order to improve the efficiency and/or effectiveness of the flushing step. In embodiments having movable nozzles 120, corresponding actuators (not shown) can move the nozzles 120 closer to the opening 14 and, preferably, into the open end 55 of a package 50 in order to introduce inert gas directly into the package 50 (as opposed to supplying the inert gas first to the flusher chamber 10-*xf* and subsequently transferring the inert gas into the package 50 by overpressure in the flusher chamber 10-*xf* and/or aspiration exerted from an expanding package 50, expanding outside the flusher chamber 10-*xf*.

It is noted that the flusher chamber 10-*xf* may be provided with an internal pressure substantially corresponding to ambient pressure, in which case a previously (partly) evacuated package 50 can aspirate inert gas from the flusher chamber 10-*xf* by the film material relaxing from it (partially) evacuated configuration due to the lack of a significant pressure differential between the flusher chamber 10-*xf* and the ambient pressure). To this aim, the flusher chamber 10-*xf* can be provided with additional sensors (not shown) configured to detect the open end of a package 50 and to provide a signal based on the detection to the control unit, the control unit being configured to control the actuator(s) of the nozzle(s) based on the signal provided by the sensor(s). The Rollers 90 and 92 are provided at either side of the flusher chamber 10-*xf* in order to substantially seal the flusher chamber 10-*xf* from adjacent chambers (e.g. chambers 10-1 and 10-3; see FIG. 8).

FIG. 12B shows an evacuation chamber that can be employed with an evacuation station according to the present invention, the evacuation chamber having multiple compartments separated by dividers. The evacuation chamber 10-*xv* can be employed at any one or more of operating sections 200, 200', and 200. In the example shown in FIG. 12B, evacuation chamber 10-*xv* is employed at operating section 200, i.e. as a first evacuation stage in a multi-chamber evacuation station 1. Fluid connector 11-*x* is configured to connect to a suitable vacuum source (not shown) configured to provide evacuation chamber 10-*xv* with a desired vacuum pressure.

Evacuation chamber 10-*xv* further includes sub-chambers 10-*xv*-1, 10-*xv*-2, and 10-*xv*-3 separated by dividers 96. Dividers 96 are configured to facilitate a controlled fluid flow between the different sides of the divider, offering a desired resistance to the fluid flow such that a pressure differential between two adjacent sub-chambers can be created and maintained while the evacuation chamber 10-*xv* is provided with only a single fluid connector 11-*x* providing the evacuation chamber 10-*xv* with a general vacuum pressure. Further, the dividers 96 are configured to allow film 21 at the neck of packages 50 being moved through the evacuation chamber 10-*xv* to pass through the dividers without excessive friction or wear and tear on the materials involved (e.g. curtains of divider 96 or film 21). This configuration of the evacuation chamber 10-*xv* allows for a single evacuation chamber to provide different pressure differentials. In one embodiment, the pressure in the first sub-chamber 10-*xv*-1 is between 800 and 900 mbar, the pressure in the second sub-chamber 10-*xv*-2 is between 700 and 800 mbar, and the pressure in the third sub-chamber 10-*xv*-3 is between 600 and 700 mbar, thereby providing an increasing pressure differential. Such an increasing pressure differential can be beneficial when evacuating packages 50 containing a product 56 or products 56 easily affected by vacuumization (e.g. loose material or bulk goods that could interfere with evacuation), because of the gradual increase in vacuum pressure. It is noted that other intervals of increasing pressure differentials can be chosen, which have a substantially similar effect.

Figure 12C:
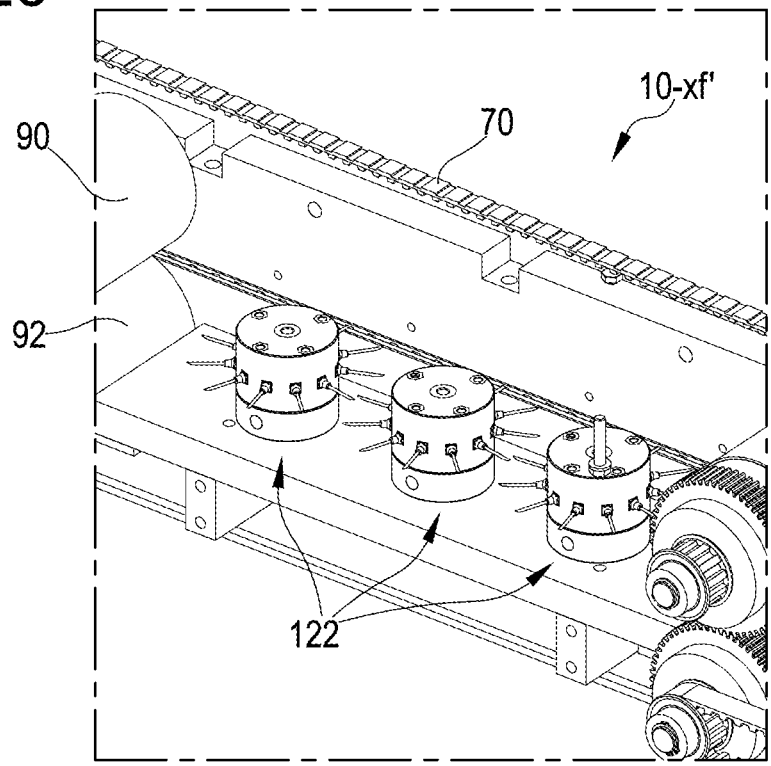
FIG. 12C shows an isometric back view of the inside of a flusher chamber that can be employed with an evacuation station according to the present invention.

FIG. 12C shows an isometric back view of the inside of a flusher chamber 10-*xf'* that can be employed with an evacuation station according to the present invention. In this embodiment, a set of flusher assemblies 122 is employed in flushing packages 50. Flusher assembly 122 are arranged in sequence along the length of the flusher chamber 10-*xf'* of the evacuation station. In this example, a total of three flusher assemblies 122 is employed. However, in other embodiments a different number of flusher assemblies 122 (e.g. 1, 2, or more than 3) may be employed.

Figure 12D:
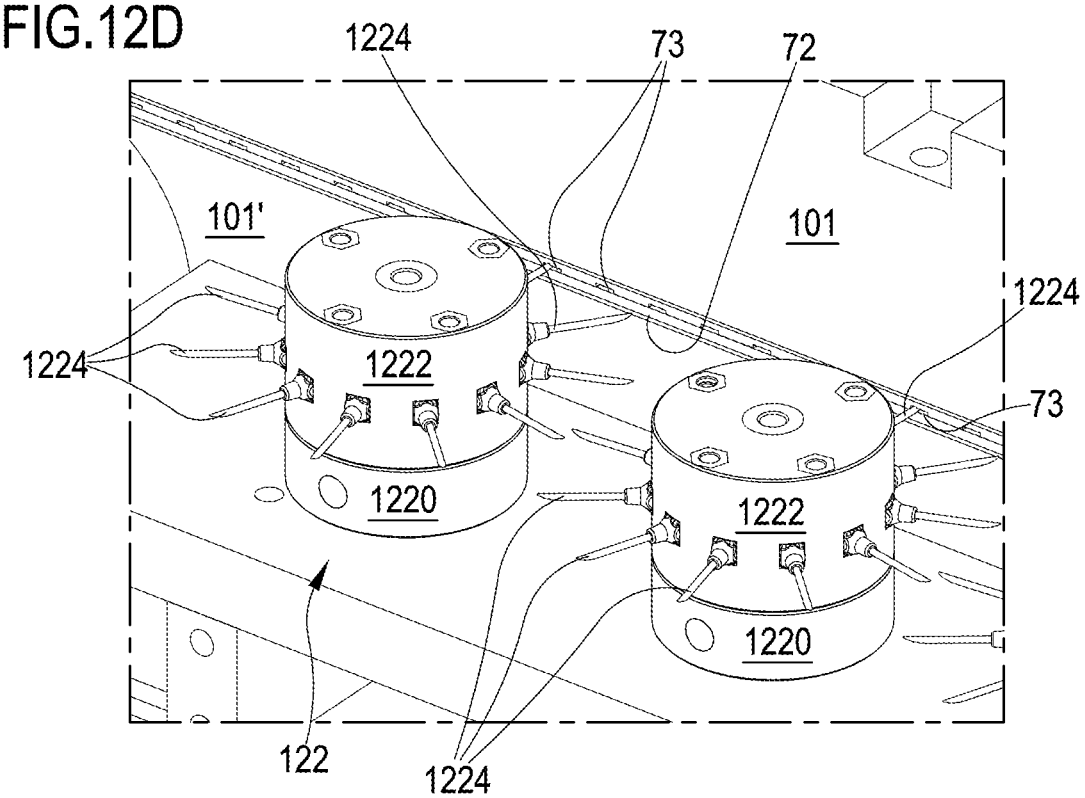
FIG. 12D shows a detailed isometric back view of the flusher chamber of FIG. 12C of an evacuation station according to the present invention.

FIG. 12D shows a detailed isometric back view of the flusher chamber of FIG. 12D of an evacuation station according to the present invention. FIG. 12D shows a set of flusher assemblies 122 that are rotatably arranged within the flusher chamber 10-*xf'*. Each flusher assembly 122 includes a set of gas flush nozzles 1224 (here shown in form of needles) which are mounted on a rotatable nozzle head 1222, which is rotatably engaged to a flusher support 1220. As detailed further below, the flusher supports 1220 are provided with a flow of gas to be used in flushing packages 50. The gas is introduced into the flusher supports 1220 from below and further distributed to the rotatable nozzle head 1222 where it is further introduced into selected gas flush nozzles 1224. The gas flush nozzles 1224 are provided in the form of needles configured to engage or otherwise synchronize with channels 73 between belts 70 and 72 such that the tips of the nozzles 1224 enter the channels 73 while the channels 73 move along the opening 14 and along the flusher chamber 10-*xf'* in the movement direction 40. This arrangement enables the nozzles to enter the bag neck of a package 50 as much as possible when releasing the gas used for flushing the package 50. In general, the deeper the nozzles 1224 can enter the bag neck of a package 50, the more efficient the flushing of the packages 50 can be effected.

FIG. 12E shows a cross section view of the flusher chamber of FIG. 12C of an evacuation station according to the present invention. As can be seen from FIG. 12E, the needles 1224 enter the channels 73 to an extend sufficient to efficiently release the gas used for flushing the packages 50 well within the bag neck (not shown) of packages 50. The nozzles 1224 (e.g. needles) are numbered and spaced in a manner corresponding to a spacing of the channels provided between belts 70 and 72. In some embodiments, the nozzle heads 1222 are driven and controlled by a dedicated drive mechanism in order to synchronously move with respect to the channels 73 between belts 70 and 72. In other examples, the nozzle heads 1222 are simply rotatable and are driven by the movement of belts 70 and 72 engaging the individual nozzles 1224 (e.g. needles).

FIG. 12 F shows isometric views of a flusher support 1220 of a flusher assembly 122 as shown in FIGS. 12D-12E that can be employed with an evacuation station according to the present invention. FIG. 12F shows a transparent view (a) of a flusher support 1220, and two isometric views (b) and (c) of a flusher support 1220, illustrating the configuration and arrangement of an internal channel 1220*c* and corresponding inlet 1220*i* and 1220*o* thereof. The gas used in flushing packages 50 is supplied to the inlets 1220*i* of each flusher support and distribute towards the flusher head 1222 by means of the channel 1220*i*. The outlet 1220*o* has an elongated shape extending along a direction of rotation of the respective nozzle head 1222 and is oriented such that only the nozzles 1224 (e.g. needles as shown in FIGS. 12D-12E) which are engaged and moving with channels 73 of belts 70 and 72 are supplied with the gas used in flushing the packages 50. In this manner, the gas is used efficiently and flushing of the packages 50 is only performed when the respective nozzles 1224 are introduced into and moving with the bag neck of packages 50.

FIG. 13 shows a cross section of a divider as shown in FIG. 12B. The cross section in FIG. 13 is taken along the dashed line XIII-XIII as shown in FIG. 12B. FIG. 13 is based on a cross section plane oriented substantially parallel to the movement direction 40 and vertical to evacuation chamber 10-*xv* (see FIG. 12B). A divider 96 as employed in evacuation chamber 10-*xv* includes supports 97 and 97' and curtains 98 and 98'. The carriers 97 and 97' are configured to support curtains 98 and 98', respectively, in a configuration that allows for film 21 of a neck of a package 50 to pass through between curtains 98 and 98' while adjacent volumes of air or gas are substantially isolated from one another. As can be seen from FIG. 13, curtains 98 and 98' can be deformed in order to facilitate passing through of film 21 while engaging one another in order to provide a substantially airtight contact. The curtains include a non-rigid material in order to allow for flexibly accommodating the film 21 going through while returning, after any deformation or movement, into the configuration shown in FIG. 13. The curtains 98 and 98' can be made from, for example, fiber reinforced polyester conveyor belt material, flexible plastic (PA, POM), or metal (inox steel, 12R11) coated by rubber.

FIG. 14 shows an isometric view of an outlet section of an evacuation station according to the present invention. The outlet section 300 includes rollers 90 and 92 configured to define a substantially sealed terminal portion of the vacuum chamber 10. Further, two gears 108 and 108' (not shown in FIG. 14, because the gears are covered by gears 106 and 106') correspond to gears 104 and 104' and act as deflection gears for the belts 70 and 72. Gears 106 and 106' and deflection gears 107 and 107' guide stretch belts 80 and 82 in a plane parallel and adjacent to a guidance plane of the belts 70 and 72. The stretch belts 80 and 82 are configured to receive film 21 at the neck of packages 50 exiting the vacuum chamber 10 and to stretch the film material in order to substantially reduce or eliminate any wrinkles present in the film material before sealing. This can be achieved by operating the stretch belts 80 and 82 at a speed higher than the operating speed of the belts 70 and 72, for example by providing the stretch belts 80 and 82 with a separate drive motor or by providing a suitable transmission as a mechanical coupling between the common drive motor 95 and the gears/sprockets driving the stretch belts 80 and 82. The stretch belts 80 and 82 are preferably operated at an operating speed of about 2% to 30% higher than the relative speed between the package 50 and the vacuum chamber 10, the operating speed more preferably being about 3% to 12% higher than the relative speed between the package 50 and the vacuum chamber 10. In some embodiments, the operating speed of the stretch belts 80 and 82 is about 4% to 8% higher than the relative speed between the package 50 and the vacuum chamber 10, in order to ensure that wrinkles generated in the bag neck at an upstream end of the vacuum chamber 10 are effectively reduced or eliminated before sealing.

The sealing rollers 24 are configured to provide the neck of each package 50 exiting the vacuum chamber 10 with a seal. Sealing is performed in a continuous manner as packages 50 exit evacuation station 1. Pushers 105 and 105' are configured to act upon the stretch belts 80 and 82 ensure that in the final stage before sealing substantially no or very little air or gas can enter the evacuated packages 50. Pushers 105 and 105' can be mechanical pushers (e.g. based on one or more springs pushing a contact element on the belts 80 and 82) or based on a pneumatic system as described above with respect to channels 74. In some embodiments, sealing means (e.g. sealing rollers 24) may be arranged differently, such that sealing may be performed while packages 50 are still being evacuated. In such embodiments the sealing means may be arranged at the end of, or within, the evacuation station 300. Such an arrangement of the sealing means may entail the advantage that evacuation is optimized and air/gas is prevented from entering the packages 50 after evacuation has been concluded, but before sealing has been performed.

The belts 80 and 82 preferably have substantially flat outer surfaces configured to contact film 21 at the neck of packages 50 in order to stretch the film material and in order to substantially reduce or eliminate any wrinkles present in the film material before sealing. This can be achieved by substantially flat outer surfaces and a higher operating speed of the belts 80 and 82 with respect to an operating speed of the belts 70 and 72. The outlet section 300 can further include knives or blades (not shown in FIG. 14) configured to cut excess material from the sealed end of packages 50. The stretch belts 80 and 82 are further configured to expel packages 50 from evacuation station 1 so that a continuous processing and delivery of packages 50 is ensured.

FIG. 14A shows an isometric front view of an outlet section 300 in accordance with embodiments of the present invention, the outlet section 300 being provided with a separate exit belt 30*c*. In order to prevent or minimize the mechanical stress exerted on the sealing and/or the film material during the stretching, the exit belt 30*c* may be operated at a higher operating speed, preferably synchronous with the operating speed of the stretch belts 80 and 82. In this manner, the stretching of the bag neck of packages 50 before, during, and after sealing is met with the package 50 being conveyed at a substantially synchronized speed with respect to the stretch belts 80 and 82.

Figure 15:
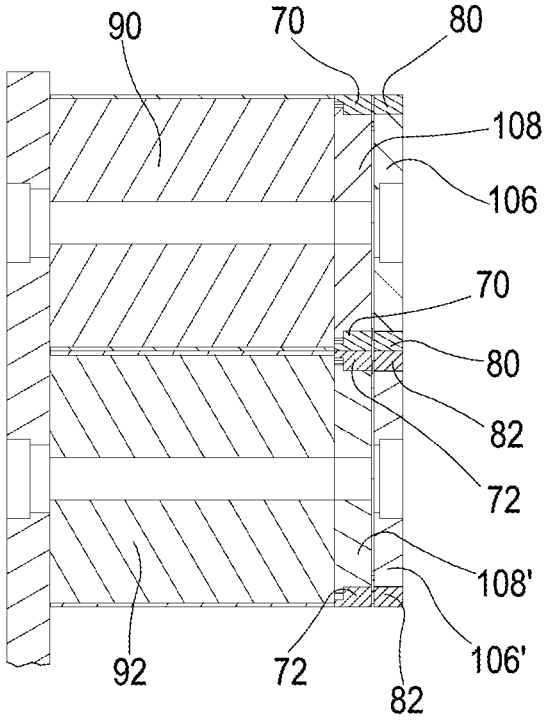
FIG. 15 shows a cross section of the outlet section shown in FIG. 14, illustrating the configuration of upper and lower belts overlapping in the outlet section.

FIG. 15 shows a cross section of the outlet section shown in FIG. 14, illustrating the configuration of upper and lower belts overlapping in the outlet section. The cross section in FIG. 15 is taken along the dashed line XV-XV as shown in FIG. 14. FIG. 15 is based on a cross section plane oriented substantially perpendicular to the movement direction 40 and vertical to vacuum chamber 10 (see FIG. 14). FIG. 15 illustrates an area of overlap between the belts 70/72 and the belts 80/82, which overlap at least in an operating region of gears 108/108' and gears 106/106', which share a common rotation axis (i.e. gears 108 and 106 share a common rotation axis and gears 108' and 106' share a common rotation axis). This configuration of belts and gears ensures that film material at the neck of packages 50 smoothly transitions from operating section 200" towards and through operating section 300 (see FIGS. 1 and 2), due to the overlap between the belts. The stretch belts 80 and 82 are configured to substantially prevent any air or gas from entering the evacuated packages 50 and sealing rollers 24 (not shown in FIG. 15) provide the packages 50 with a seal while the belts 80 and 82 act upon the film 21 at the neck of packages 50.

FIG. 15A shows a cross section view of a stretch belt 80, 82 in accordance with embodiments of the present invention. The stretch belts 80 and 82 may have a substantially flat configuration as described above, in which substantially flat contact surfaces of both belts 80 and 82 contact each other and engage film material between the belts. This may require the belts 80 and 82 to be pressed against one another using corresponding means, for example pressurized air applied to the belts from a direction opposite the contact surfaces. In other examples, pushers 105 and 105' may be employed to mechanically push belts 80 and 82 towards one another in order to achieve the necessary pressure for sufficiently holding the film material of packages 50 during stretching. In the embodiment shown in FIG. 15A, contoured belts 80 and 82 are employed in order to provide the belts 80 and 82 with additional grip, thereby reducing or eliminating the pressure needed for substantially flat belts 80 and 82 as described above. In this embodiment the belts 80 and 82 are provided with a longitudinal contour in which a projection of one belt (e.g. belt 82 as shown) engages a recess in the other belt (e.g. belt 80 as shown) so that film material introduced between the two belts 80 and 82 is held based on the film material being forced to conform to the shapes of the belts 80 and 82. In this manner, the requirement of having a vertical pressure exerted upon the belts is shifted to the belt material engaging and, thus, exerting a lateral force upon the film material. This can entail advantages during the stretching of film material of packages when undergoing sealing at the sealing station 300.

Figure 16:
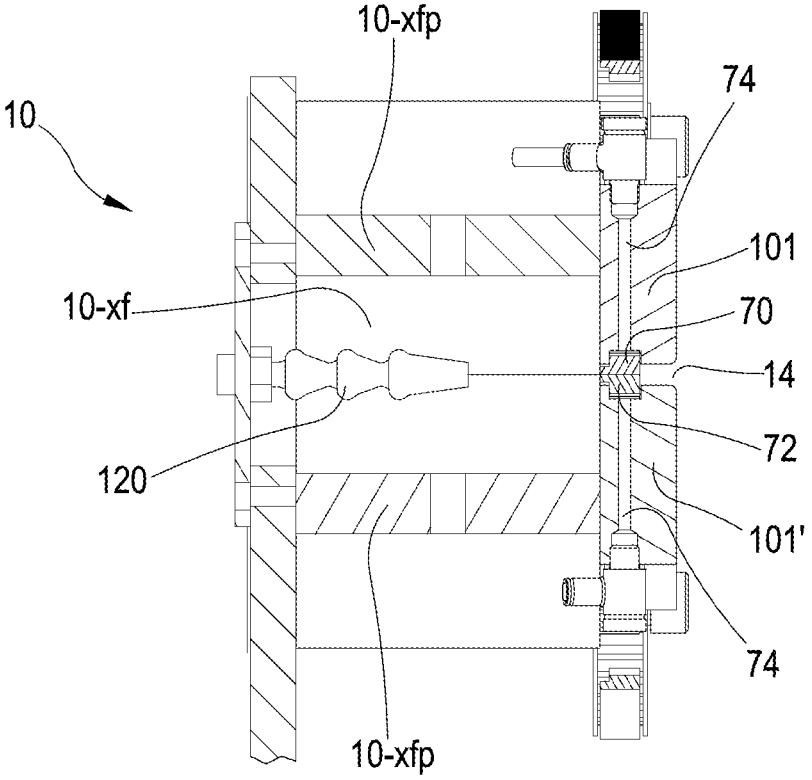
FIG. 16 shows a cross section of a flusher chamber as shown in FIG. 12A.

FIG. 16 shows a cross section of a flusher chamber as shown in FIG. 12A. The cross section in FIG. 16 is taken along the dashed line XVI-XVI as shown in FIG. 12A. FIG. 16 is based on a cross section plane oriented substantially perpendicular to the movement direction 40 and vertical to vacuum chamber 10 (see FIG. 12A). Upper and lower walls 10-*xfp* may be provided as shown in FIG. 16, delimiting the flusher chamber 10-*xf* vertically. In some embodiments, the upper and lower walls 10-*xfp* may be located closer to the nozzles 120 in order to reduce or minimize the volume of the flusher chamber 10-*xf* and/or in order to guide the bag neck (not shown) of a package 50 and position it close to the nozzles 120. Arranging the upper and lower walls 10-*xfp* proximal to the nozzles may entail improved efficiency and/or effectiveness in flushing the packages 50 with the inert gas.

FIG. 16 further illustrates the configuration of the channels 74 which are provided in supports 101 and 101'. The channels 74 are configured to pneumatically adjust a pressure exerted between adjacent portions of the belts 70 and 72. It is noted that in alternative embodiments, a mechanical adjustment can be implemented (e.g. electrically using actuators or mechanically using springs or elastic elements). In the preferred embodiment shown in FIG. 16, the adjustment is performed pneumatically using pressurized air.

Generally, the adjacent portions of the belts 70 and 72 should exert little or no pressure on layers of film 21 positioned between the belts 70 and 72. However, in some applications and/or some stages of evacuation, it can be beneficial to enhance the sealing contact between the adjacent portions of the belts 70 and 72, for example during flushing, in order to minimize loss of inert gas. In order to enhance the sealing contact, pressurized air can be introduced through channels 74, thereby forcing the adjacent portions of the belts 70 and 72 against one another, depending upon the pressure of the air provided. As each channel 74 has a rather local effect on a respective section of one of the belts 70 and 72 (e.g. being effective along a section of 5 to 10 cm), the individual pressure and/or duration can be set and/or modulated as desired.

A control unit (see above) can be configured to control a source of pressurized air and corresponding valves in fluid communication with channels 74 to provide a predetermined pressurized air flow such that a desired pressure is exerted upon the adjacent portions of the belts 70 and 72. Different channels 74 (e.g. each extending vertically and perpendicular to the movement direction 40, arranged in series along the length of vacuum chamber 10 in support 101 and/or support 101') can be supplied with the same or different pressure in order to adjust and/or modulate the pressure exerted upon adjacent portions of the belts 70 and/or 72.

Figure 16A:
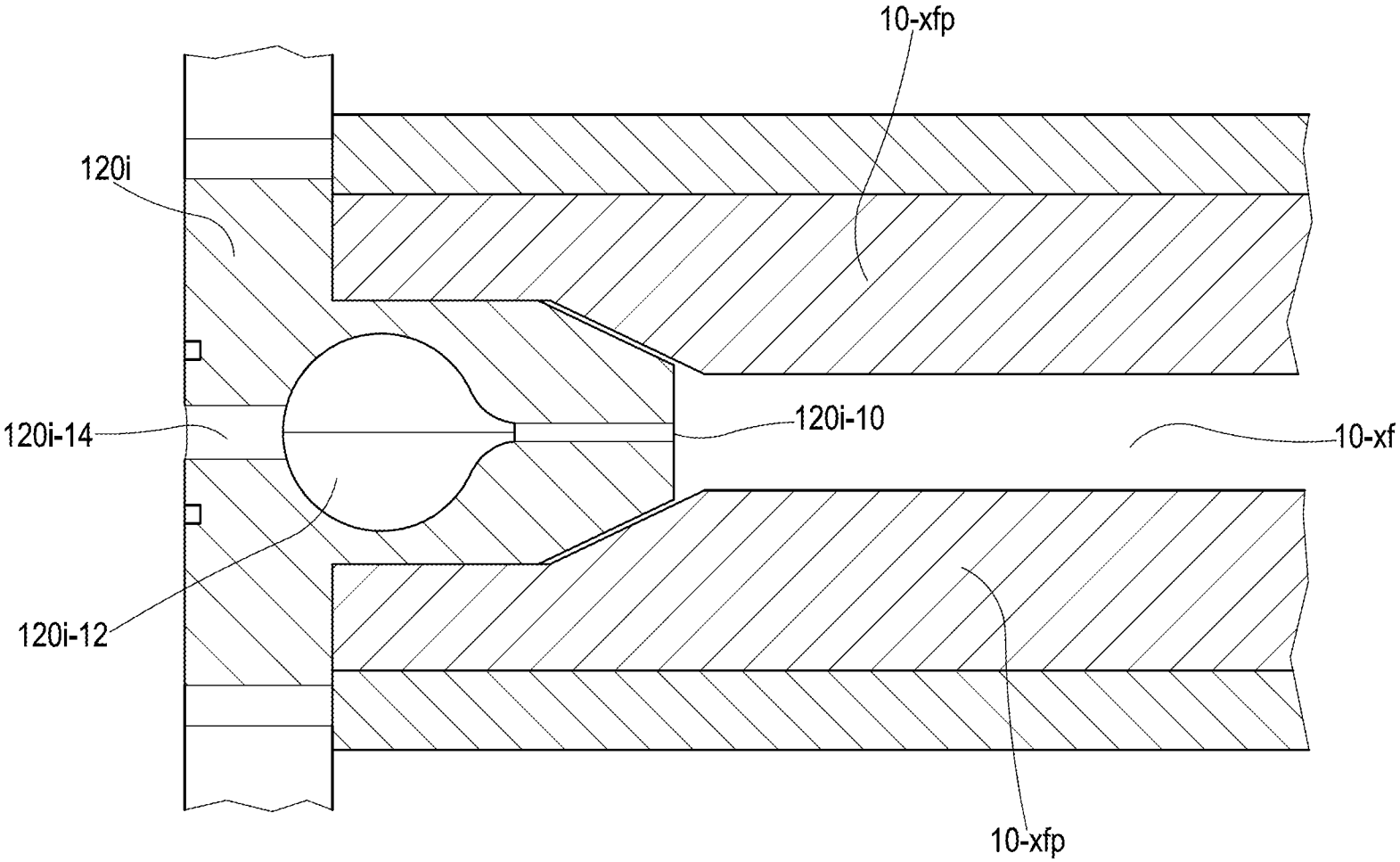
FIG. 16A shows a cross section of an alternative embodiment of a flusher chamber including one or more integrated nozzles.

FIG. 16A shows a cross section of an alternative embodiment of a flusher chamber 10-*xf* including one or more integrated nozzles 120*i*. Integrated nozzles 120*i* are similar in function to nozzles 120 as discussed above with respect to FIGS. 12A and 16, but are integrally formed with a back wall of the flusher chamber 10-*xf* located opposite the belts 70 and 72, as well as opening 14. Integrated nozzles 120*i* may include one or more supply channels 120*i*-14 respectively feeding nozzle chambers 120*i*-12 and one or more outlets 120*i*-10. The nozzle chambers 120*i*-12 and outlets 120*i*-10 are configured to create a well-focused flow of gas directed towards the opening 14 (not shown), along which the opened bag neck of a package 50 is guided during flushing.

The outlets 120*i*-10 may be provided in form of a plurality of discrete openings arranged along an elongated integrated nozzle 120*i* extending substantially parallel to the opening 14. Each of the plurality of openings is spaced apart from adjacent openings in a manner allowing for a flow of gas being provided along substantially the length of the corresponding elongated integrated nozzle 120*i*. In other embodiments, a single outlet 120*i*-10 is provided in form of an elongated opening extending along an elongated integrated nozzle 120*i*, which in turn extends substantially parallel to the opening 14. The elongated opening allows for a flow of gas being provided along substantially the length of the corresponding elongated integrated nozzle 120*i*. A flusher chamber 10-*xf* may be provided with one or more (elongated) integrated nozzles 120*i* of either type (e.g. including a plurality of discrete opening or a single elongated opening) in order to provide a flow of gas along substantially the entire length of the flusher chamber 10-*xf*.

As discussed above with respect to FIG. 16, the upper and lower walls 10-*xfp* may be provided in close proximity to the integrated nozzles 120*i* in order to reduce or minimize the volume of the flusher chamber 10-*xf* and/or in order to guide the bag neck of a package 50 being processed.

The packaging can comprise a multi-layer film 21. The film 21 can comprise PET, PA, or polyolefin (PP, PE). The film 21 can be a fully coextruded shrinkable film 21. The package provides a barrier to gas passing between the interior of the package to the exterior of the package. Accordingly, the environment inside the package is isolated from the environment outside the package. This helps to preserve food products 56 and to avoid contamination. This can be advantageous with respect to food hygiene. The package 50 can provide a barrier to aromas or to gasses. This can be particularly useful when the product 56 is a food product. The package can be abuse-resistant.

The packaging can be transparent or translucent. This allows a customer to see the product 56 through the packaging. For example, the packaging may comprise a transparent film 21. The packaging film can have anti-fog properties. This ensures high consumer appeal. The packaging film can be printable. This allows labels to be printed directly onto the packaging.

The packaging may be formed from a roll of film 21. The tubular film 21 can be made by forming a tube from the roll of film 21. The packaging apparatus can comprise a forming station configured to form the roll of film 21 into a tube. The forming station can form the tube by forming a longitudinal seal along the longitudinal edges of the roll of film 21. The tube may be formed from two webs of film 21. In this case, the forming station forms two longitudinal seals along the opposing edges of the two rolls of film 21.

The packaging apparatus can comprise a flusher. The flusher is configured to flush gas through the tube of film 21 that forms the packaging. The gas flush may prevent the tube from collapsing. The gas flush helps to maintain a distance between a product 56 in a tray and the film 21. This helps to improve the hygienic appearance of the film 21 because the film 21 remains untarnished by the product. The flusher flushes gas longitudinally through the tube. The gas used for flushing can comprise about 70% oxygen and about 30% carbon dioxide or other suitably modified atmosphere.

Additionally, the flush gas allows the product 56 to be packaged in a modified atmosphere. The gas may help to preserve the product 56, prolonging its shelf life. The desired amount of gas inside each sealed package depends on the type of product 56 and the length of shelf life needed.

The packaging apparatus can comprise a shrink station configured to shrink the film 21. The shrink station may be a water- or air-based shrink tunnel, for example a hot air tunnel. After sealing, packages 50 undergo heat-shrinking in the shrink station. The shrinking process may involve heating the packages 50. The packages 50 may be heated to a temperature within the range of from about 130° C. to about 150° C.

The product 56 can be a food product. For example, the product 56 may comprise meat, cheese, pizza, ready meals, poultry and fish. The product 56 may be substantially dry, as in the case of cheese. For some products, such as cheese, there is no need for a tray to support the cheese. Alternatively, the product 56 may be wet. In this case, it is particularly desirable for the product 56 to be disposed in a tray. Further, the product 56 can also be a non-food product, for example including clothes, sheets, textile material or other compliant material. In such applications, the volume of packaged products can be reduced significantly, thereby providing substantial advantages regarding shipping and/or storage space requirements. The products 56 can further include soft or rigid products, bulk goods, or other items. In packaging applications for medical goods, the storage life of the packaged products can be significantly increased, for example by keeping the products 56 sealed and isolated from the outside atmosphere and/or in an inert and/or sterile internal environment.

Desirably, the packaging apparatus comprises a horizontal form fill and seal machine. However, the packaging apparatus may comprise other types of form fill and seal machines, such as a vertical form fill and seal (VFFS) machine. In a vertical form fill and seal machine, the packages 50 move through the packaging apparatus in a vertical direction during the packaging process. In a VFFS machine, the packaging may be sealed once to form the lower end of a sealed package. The product 56 is then fed into the open-ended package. The top end of the package 50 is then sealed to form a sealed package.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

The invention claimed is:

1. A device (1) for evacuating gas from a package (50) in a packaging apparatus, the package (50) having an open end (55), the open end (55) having a terminal portion (54), a non-terminal portion (52), and an intermediate portion (53) located between the terminal portion (54) and the non-terminal portion (52) of the open end (55), the device (1) comprising:

a vacuum chamber (10) having an elongated opening (14) extending along a longitudinal axis of the vacuum chamber (10), an evacuation means configured for providing the vacuum chamber (10) with an internal vacuum pressure that is lower than an ambient pressure outside the vacuum chamber (10), a means for moving (30) a package (50) relative to the vacuum chamber (10), and a control unit (60) programmed for:

controlling the means for moving (30) to relatively move a package (50) to be evacuated with respect to the vacuum chamber (10), the package (50) and the means for moving (30) each being arranged with respect to the vacuum chamber (10) so that a main movement direction (40) of packages (50) placed on the means for moving (30) and the longitudinal axis of the vacuum chamber (10) are substantially parallel to one another, the package (50) to be evacuated being positioned so that, during the relative movement of the package (50) with respect to the vacuum chamber (10), a terminal portion (54) of the open end (55) of the package (50) relatively moves within the vacuum chamber (10) and a non-terminal portion (52) of the open end (55) of the package (50) relatively moves outside the vacuum chamber (10), an intermediate portion (53) of the open end (55) of the package (50) passing through and relatively moving along the opening (14), and activating the evacuation means to provide the vacuum chamber (10) with the internal vacuum pressure;

the device (1) further comprising a first guide belt (70) arranged along a length of the opening (14) and configured to contact the intermediate portion (53) of the open end (55) of the package (50) when passing through the opening (14), the first guide belt (70) having an inner surface (70*i*) and an outer surface (70*o*), and a first drive configured to act on the first guide belt (70), wherein the control unit is further programmed to control the first drive to move the first guide belt (70) in the movement direction (40) along the length of the opening (14);

wherein the outer surface (70*o*) of the first guide belt (70) is provided with a contoured shape comprising recesses (73);

a second guide belt (72) arranged along a length of the opening (14) and configured to contact the intermediate portion (53) of the open end (55) of the package (50) when passing through the opening (14), the second guide belt (72) having an inner surface (72*i*) and an outer surface (72*o*), and a second drive configured to act on the second guide belt (72), wherein the control unit is further programmed to control the second drive to move the second guide belt (72) in the movement direction (40) along the length of the opening (14);

the second guide belt (72) has the form of a closed loop running around first (103') and second (108') deflection rolls and along the length of the opening (14).

2. The device of claim 1, wherein the control unit is further programmed to control the internal vacuum pressure for:

allowing a gas flow through the opening (14) causing opposing layers of film (21) at the open end (55) of the package (50) to maintain a substantially spaced-apart configuration; and/or aspirating both gas from inside the package (50) and gas from an ambient atmosphere through the opening (14).

3. The device of claim 1, wherein the first guide belt (70) has the form of a closed loop running around first (103) and second (108) deflection rolls and along the length of the opening (14).

4. The device of claim 1, wherein the recesses (73) extend over the outer surface (70*o*) in a direction perpendicular to a longitudinal extension of the first guide belt (70) and wherein the recesses (73) are spaced from one another at regular intervals between 2 mm and 20 mm along the longitudinal extension of the first guide belt (70).

5. The device of claim 4, wherein the recesses (73) have a depth of between 0.2 mm and 2 mm, and the recesses (73) have a length along the longitudinal extension of the first guide belt (70) of between 2 mm and 10 mm.

6. The device of claim 1, wherein the control unit is further programmed to control the second drive to move the second guide belt (72) in the movement direction (40) along the length of the opening (14), at a speed substantially corresponding to the relative speed between the package (50) and the vacuum chamber (10) and wherein the outer surface (72*o*) of the second guide belt (72) is provided with a substantially even shape.

7. The device of claim 6, wherein the inner surface (70*i*) of the first guide belt (70) extends along an upper edge (14*u*) of the opening (14) and the outer surface (70*o*) of the first guide belt (70) is configured to contact the intermediate portion (53) from above, and the inner surface (72*i*) of the second guide belt (72) extends along a lower edge (141) of the opening (14) and the outer surface (72*o*) of the second guide belt (72) is configured to contact the intermediate portion (53) from below.

8. The device of claim 1, further comprising multiple sets of upper (90) and lower (92) rollers, each roller (90, 92) having a substantially cylindrical shape and being arranged to be able to rotate about a respective longitudinal axis thereof, the upper (90) and lower (92) rollers being relatively positioned with respect to one another such that the upper (90) and lower (92) rollers contact each other along an elongated contact area on their respective lateral surfaces, thereby providing the rollers (90, 92) with a substantially air-tight seal along the contact area, the contact area extending substantially parallel to the respective longitudinal axis of the upper (90) and lower (92) rollers, wherein:

a first set of rollers (90, 92) is arranged at an upstream end of the vacuum chamber (10) and configured to provide the vacuum chamber (10) with a substantially air-tight seal at the upstream end thereof; and/or a second set of rollers (90, 92) is arranged at a downstream end of the vacuum chamber (10) and configured to provide the vacuum chamber (10) with a substantially air-tight seal at the downstream end thereof, downstream being defined with respect to the main movement direction (40).

9. The device of claim 1, further comprising a first stretch belt (80) arranged at the downstream end of the vacuum chamber (10) and configured to receive the intermediate portion (53) of the open end (55) when exiting the opening (14).

10. The device of claim 9, further comprising a second stretch belt (82) arranged opposite to and in contact with the first stretch belt (80) at the downstream end of the vacuum chamber (10), the first (80) and second (82) stretch belts being configured to receive, between one another, the intermediate portion (53) of the open end (55) when exiting the opening (14) and wherein the control unit is configured to control an operating speed of the second stretch belt (80) to be higher than the relative speed between the package (50) and the vacuum chamber (10), the operating speed being about 2% to 30% higher than the relative speed between the package (50) and the vacuum chamber (10).

11. The device of claim 1, wherein the control unit is configured to control an operating speed of the first stretch belt (80) to be higher than the relative speed between the package (50) and the vacuum chamber (10), the operating speed being about 2% to 30% higher than the relative speed between the package (50) and the vacuum chamber (10).

12. The device of claim 1, wherein the opening (14) has a height of between 0.3 mm and 1.0 mm; and the opening (14) has a depth of 50 mm or less.

13. A device (1) for evacuating gas from a package (50) in a packaging apparatus, the package (50) having an open end (55), the open end (55) having a terminal portion (54), a non-terminal portion (52), and an intermediate portion (53) located between the terminal portion (54) and the non-terminal portion (52) of the open end (55), the device (1) comprising:

a vacuum chamber (10) having an elongated opening (14) extending along a longitudinal axis of the vacuum chamber (10), an evacuation means configured for providing the vacuum chamber (10) with an internal vacuum pressure that is lower than an ambient pressure outside the vacuum chamber (10), a means for moving (30) a package (50) relative to the vacuum chamber (10), and a control unit (60) programmed for:

controlling the means for moving (30) to relatively move a package (50) to be evacuated with respect to the vacuum chamber (10), the package (50) and the means for moving (30) each being arranged with respect to the vacuum chamber (10) so that a main movement direction (40) of packages (50) placed on the means for moving (30) and the longitudinal axis of the vacuum chamber (10) are substantially parallel to one another, the package (50) to be evacuated being positioned so that, during the relative movement of the package (50) with respect to the vacuum chamber (10), a terminal portion (54) of the open end (55) of the package (50) relatively moves within the vacuum chamber (10) and a non-terminal portion (52) of the open end (55) of the package (50) relatively moves outside the vacuum chamber (10), an intermediate portion (53) of the open end (55) of the package (50) passing through and relatively moving along the opening (14), and activating the evacuation means to provide the vacuum chamber (10) with the internal vacuum pressure;

one or more flusher assemblies (122), each of the one or more flusher assemblies (122) comprising a flusher support (1220) rotatably carrying a nozzle head (1222), the nozzle head having a plurality of nozzles (1224)

the device (1) further comprising a first guide belt (70) arranged along a length of the opening (14) and configured to contact the intermediate portion (53) of the open end (55) of the package (50) when passing through the opening (14), the first guide belt (70) having an inner surface (70*i*) and an outer surface (70*o*), and a first drive configured to act on the first guide belt (70), wherein the control unit is further programmed to control the first drive to move the first guide belt (70) in the movement direction (40) along the length of the opening (14);

wherein the outer surface (70*o*) of the first guide belt (70) is provided with a contoured shape comprising recesses (73); wherein the recesses (73) extend over the outer surface (70*o*) in a direction perpendicular to a longitudinal extension of the first guide belt (70) and wherein the recesses (73) are spaced from one another at regular intervals between 2 mm and 20 mm along the longitudinal extension of the first guide belt (70);

a second guide belt (72) arranged along a length of the opening (14) and configured to contact the intermediate portion (53) of the open end (55) of the package (50) when passing through the opening (14), the second guide belt (72) having an inner surface (72*i*) and an outer surface (72*o*), and a second drive configured to act on the second guide belt (72), wherein the control unit is further programmed to control the second drive to move the second guide belt (72) in the movement direction (40) along the length of the opening (14);

the second guide belt (72) has the form of a closed loop running around first (103') and second (108') deflection rolls and along the length of the opening (14).

14. The device of claim 13, wherein each nozzle of the plurality of nozzles is configured to engage and disengage a respective recess of the recesses (73) during movement of the first guide belt (70), thereby being positioned, when engaged, at least partially within the open end (55) of the package (50).

15. The device of claim 13, wherein the flusher support (1220) further comprises a conduit (1220*i*, 1220*c*, 1220*o*) configured to direct a flow of controlled gas towards the respective nozzle or nozzles of the plurality of nozzles (1224) while engaging a corresponding recess of the recesses (73), optionally wherein the conduit is further configured to prevent a supply of controlled gas to the respective nozzle or nozzles of the plurality of nozzles (1224) while not engaging a corresponding recess of the recesses (73).

16. A packaging process for use with a device (1) according to claim 1 for evacuating gas from a package (50) in a packaging apparatus, the process comprising: providing a package (50) containing a product (56) to be packaged, the package (50) being made from a film (21) and having an open end (55), wherein the step of providing the package (50) comprises creating the open end (55) of the package (50) by one or more of:

a. perforating the package (50) in the region of the terminal portion (54) of the open end (55);
b. cutting the package (50) in the region of the terminal portion (54) of the open end (55); and
c. creating an aperture in the package (50) in the region of the terminal portion (54) of the open end (55), providing a vacuum chamber (10) having an elongated opening (14), relatively moving one of the package (50) and the vacuum chamber (10) with respect to the other such that a terminal portion (54) of the open end (55) of the package (50) relatively moves within the vacuum chamber (10) and a non-terminal portion (52) of the open end (55) of the package (50) relatively moves outside the vacuum chamber (10), an intermediate portion (53) of the open end (55) of the package (50) passing through the opening (14) and relatively moving along a length thereof, the intermediate portion (53) extending between the terminal portion (54) and the non-terminal portion (52) of the open end (55) of the package (50), creating, within the vacuum chamber (10), an internal vacuum pressure that is lower than an ambient pressure outside the vacuum chamber (10); and flushing the inside of the package (50) with gas or a mixture of gases.

17. The process of claim 16, further comprising:

guiding the intermediate portion (53) of the open end (55) of the package (50) along a length of the opening (14) while relatively moving one of the package (50) and the vacuum chamber (10) with respect to the other; and/or creating wrinkles in the film (21) at the open end (55) of the package (50); and/or removing wrinkles from and/or flattening the film (21) at the open end of the package (50); and/or creating elongated wrinkles in the film (21) an area of the package (50) substantially in contact with the means for moving (30).

18. The process of claim 16, further comprising allowing lateral movement of the package (50) and/or of the film material at the open end (55) of the package (50) in a direction perpendicular to the movement direction (40) such that a change in volume of the package (50) and/or a change in the shape of the film (21) of the package (50) while relatively moving one of the package (50) and the vacuum chamber (10) with respect to the other can be accommodated.

19. A packaging apparatus comprising:

a device (1) for evacuation gas coupled to a control unit (60); and an output station; wherein the device (1) for evacuating gas from a package (50) in a packaging apparatus, the package (50) having an open end (55), the open end (55) of the package (50) having a terminal portion (54), a non-terminal portion (52), and an intermediate portion (53) located between the terminal portion (54) and the non-terminal portion (52) of the open end (55), the device (1) comprising:

a vacuum chamber (10) having an elongated opening (14) extending along a longitudinal axis of the vacuum chamber (10), an evacuation means configured for providing the vacuum chamber (10) with an internal vacuum pressure that is lower than an ambient pressure outside the vacuum chamber (10), a means for moving (30) a package (50) relative to the vacuum chamber (10), and the control unit (60) programmed for:

controlling the means for moving (30) to relatively move a package (50) to be evacuated with respect to the vacuum chamber (10), the package (50) and the means for moving (30) each being arranged with respect to the vacuum chamber (10) so that a main movement direction (40) of packages (50) placed on the means for moving (30) and the longitudinal axis of the vacuum chamber (10) are substantially parallel to one another, the package (50) to be evacuated being positioned so that, during the relative movement of the package (50) with respect to the vacuum chamber (10), a terminal portion (54) of the open end (55) of the package (50) of the package (50) relatively moves within the vacuum chamber (10) and a non-terminal portion (52) of the open end (55) of the package (50) relatively moves outside the vacuum chamber (10), an intermediate portion (53) of the open end (55) of the package (50) passing through and relatively moving along the opening (14), and activating the evacuation means to provide the vacuum chamber (10) with the internal vacuum pressure;

the device (1) further comprising a first guide belt (70) arranged along a length of the opening (14) and configured to contact the intermediate portion (53) of the open end (55) of the package (50) when passing through the opening (14), the first guide belt (70) having an inner surface (70*i*) and an outer surface (70*o*), and a first drive configured to act on the first guide belt (70), wherein the control unit is further programmed to control the first drive to move the first guide belt (70) in the movement direction (40) along the length of the opening (14)

wherein the outer surface (70*o*) of the first guide belt (70) is provided with a contoured shape comprising recesses (73);

a second guide belt (72) arranged along a length of the opening (14) and configured to contact the intermediate portion (53) of the open end (55) of the package (50) when passing through the opening (14), the second guide belt (72) having an inner surface (72*i*) and an outer surface (72*o*), and a second drive configured to act on the second guide belt (72), wherein the control unit is further programmed to control the second drive to move the second guide belt (72) in the movement direction (40) along the length of the opening (14);

the second guide belt (72) has the form of a closed loop running around first (103') and second (108') deflection rolls and along the length of the opening (14); and the control unit is configured to control the means for moving (30) to move one or more packages (50), each containing a product (56) to be packaged, towards and through the device (1), and towards the output station.

* * * * *